US006438946B1

(12) United States Patent
Majima et al.

(10) Patent No.: US 6,438,946 B1
(45) Date of Patent: Aug. 27, 2002

(54) EXHAUST GAS PURIFICATION DEVICE FOR ENGINES

(75) Inventors: Yoshihiro Majima, Inuyama; Yukihiro Yamashita, Takahama; Noriaki Ikemoto, Kariya, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/678,342

(22) Filed: Oct. 3, 2000

(30) Foreign Application Priority Data

Oct. 29, 1999 (JP) ..... 11-307931
Jul. 28, 2000 (JP) ..... 2000-233191

(51) Int. Cl.[7] ..... F01N 3/00

(52) U.S. Cl. ..... 60/285; 60/276; 60/288; 60/299

(58) Field of Search ..... 60/276, 285, 288, 60/295, 301, 299; 123/692, 691; 73/118.1

(56) References Cited

U.S. PATENT DOCUMENTS 5,233,829 A * 8/1993 Komatsu ..... 60/285
5,394,691 A * 3/1995 Seki ..... 60/285
5,417,058 A * 5/1995 Shimizu ..... 60/285
5,537,817 A * 7/1996 Akazaki et al. ..... 60/285
5,570,574 A * 11/1996 Yamashita et al. ..... 60/285
5,657,627 A * 8/1997 Akazaki et al. ..... 60/285
5,758,491 A 6/1998 Agustin et al.
6,256,981 B1 * 7/2001 Sullivan et al. ..... 60/285

FOREIGN PATENT DOCUMENTS

JP 2936898 5/1960

* cited by examiner

*Primary Examiner*—Thomas Denion
*Assistant Examiner*—Diem Tran
(74) *Attorney, Agent, or Firm*—Nixon & Vanderhye P.C.

(57) ABSTRACT

A plurality of catalysts are installed in an exhaust pipe, air-fuel ratio sensors or oxygen sensors are installed upstream and downstream of each catalyst, and the air-fuel ratio of the exhaust gas is feedback controlled to a target air-fuel ratio based on the output of the air-fuel ratio sensor located upstream of the upstream catalyst. In this the exhaust gas is sufficiently purified with the upstream catalyst alone when the exhaust gas flow rate is small, the oxygen sensor located downstream of the upstream catalyst is used as the downstream sensor for setting a target air-fuel ratio. Furthermore, when the exhaust gas flow rate increases, the amount of exhaust gas components passing through without purification in the upstream catalyst is increased. Therefore, the downstream sensor used for setting the air-fuel ratio is switched to the oxygen sensor located downstream of the downstream catalyst.

20 Claims, 20 Drawing Sheets

FIG. 5A

MAP FOR SENSOR 25

| QA (g/s) | 5 | 10 | 15 | 20 | 30 | 40 | 50 |
|---|---|---|---|---|---|---|---|
| λIR | 0.12 | 0.08 | 0.05 | 0.04 | 0.03 | 0.02 | 0.01 |
| λIL | 0.12 | 0.08 | 0.04 | 0.03 | 0.02 | 0.01 | 0.01 |

FIG. 5B

MAP FOR SENSOR 26

| QA (g/s) | 5 | 10 | 15 | 20 | 30 | 40 | 50 |
|---|---|---|---|---|---|---|---|
| λIR | 0.15 | 0.1 | 0.07 | 0.05 | 0.03 | 0.02 | 0.01 |
| λIL | 0.15 | 0.1 | 0.05 | 0.03 | 0.02 | 0.01 | 0.01 |

EXHAUST GAS PURIFICATION DEVICE FOR ENGINES

CROSS REFERENCE TO RELATED APPLICATION

This application is based on and incorporates herein by reference Japanese Patent Applications No. 11-307931 filed Oct. 29, 1999 and No. 2000-233191 filed Jul. 28, 2000.

BACKGROUND OF THE INVENTION

The present invention relates to an exhaust gas purification device for an internal combustion engine, in which a plurality of catalysts for exhaust gas purification are disposed in an exhaust gas channel of the internal combustion engine.

In some of recent engines, two catalysts for exhaust gas purification are disposed in series in the exhaust pipe of the engine in order to increase the exhaust gas purification capacity. In such engines, air-fuel ratio sensors (or oxygen sensors) are disposed upstream of the upstream catalyst and downstream of the downstream catalyst, respectively, and the air-fuel ratio of the exhaust gas is feedback controlled to the target air-fuel ratio based on the outputs of these upstream and downstream sensors.

Furthermore, in some of V-type engines, individual exhaust gas passages are provided for each group (each bank) of cylinders and the exhaust gas passages of each group of cylinders are combined downstream in a single collective exhaust gas passage. Respective upstream catalysts are disposed in the exhaust gas passages of each group of cylinders, and the downstream catalyst is disposed in the collective exhaust gas passage. In such engines, air-fuel ratio sensors (or oxygen sensors) are disposed upstream and downstream of the upstream catalyst, and the air-fuel ratio of the exhaust gas is feedback controlled to the target air-fuel ratio based on the outputs of these upstream and downstream sensors.

However, there is a trend toward utilization of catalysts with a high saturated adsorption amount (storage amount) of exhaust gas components with the object of meeting the requirements of exhaust gas regulations that will become increasingly stringent in the future. As a result, the exhaust gas purification systems in which two catalysts are disposed in series in an exhaust pipe have the following drawback. Thus, in a low-load operation mode, or the like, with a low flow rate of exhaust gases, the exhaust gases are sufficiently cleaned by the upstream catalyst alone. Therefore, a long time is required for the changes in the air-fuel ratio of the exhaust gas discharged from the engine to show themselves in the output changes of the sensor located downstream of the downstream catalyst, and the response of the air-fuel ratio control becomes poor.

On the other hand, in the exhaust gas purification system in which upstream catalysts are installed in each group of cylinders, since the sensors are disposed upstream and downstream of the upstream catalysts, a certain response of the air-fuel ratio control can be guaranteed. However, because the air-fuel ratio downstream of the downstream catalyst is not detected, the exhaust gas purification capacity of the whole catalytic system cannot be evaluated and the air-fuel ratio control providing for a full realization of exhaust gas purification capacity of the whole catalytic system cannot be conducted.

SUMMARY OF THE INVENTION

It is therefore an object of the present invention to provide an exhaust gas purification device for an internal combustion engine.

It is another object of the present invention to make it possible to conduct an air-fuel ratio control with good response providing for full realization of the exhaust gas purification capacity of the whole catalytic system in a system in which a plurality of catalysts for exhaust gas purification are disposed in an exhaust gas passage.

According to one aspect of the present invention, a plurality of catalysts for exhaust gas purification are disposed in an exhaust gas passage, and sensors are installed for detecting the air-fuel ratio or gas concentration in the exhaust gas upstream and downstream of each of the catalysts. With such a structure, the air-fuel ratio control with good response providing for full realization of exhaust gas purification capacity of the whole catalytic system can be conducted and the exhaust gas purification capacity can be increased by evaluating the current exhaust gas purification capacity (storage amount of each catalyst and the like) based on the outputs of the sensors disposed upstream and downstream of the catalysts. Moreover, the catalyst deterioration determination can be conducted for each of the catalysts.

According to another aspect of the present invention, no less than three catalysts are divided into a plurality of groups of catalysts, each group of catalysts is considered as a single catalyst, and sensors detecting the air-fuel ratio or gas concentration of the exhaust gas are disposed upstream and downstream of each group of catalysts. In such a case, in the system in which no less than three catalysts are disposed in an exhaust gas passage, the air-fuel ratio control with good response providing for full realization of exhaust gas purification capacity of the whole catalytic system can be conducted and the exhaust gas purification capacity can be increased by evaluating the current exhaust gas purification capacity (storage amount of each group of catalysts and the like) for each group of catalysts.

BRIEF DESCRIPTION OF THE DRAWINGS

The above and other objects, features and advantages of the present invention will become more apparent from the following detailed description made with reference to the accompanying drawings:

FIGS. 5A and 5B illustrate examples of maps of a rich integrated amount and a lean integrated amount for the sensor installed downstream of the upstream catalyst and for the sensor installed downstream of the downstream catalyst, respectively;

DETAILED DESCRIPTION OF THE PREFERRED EMBODIMENT (First Embodiment)

Figure 1:
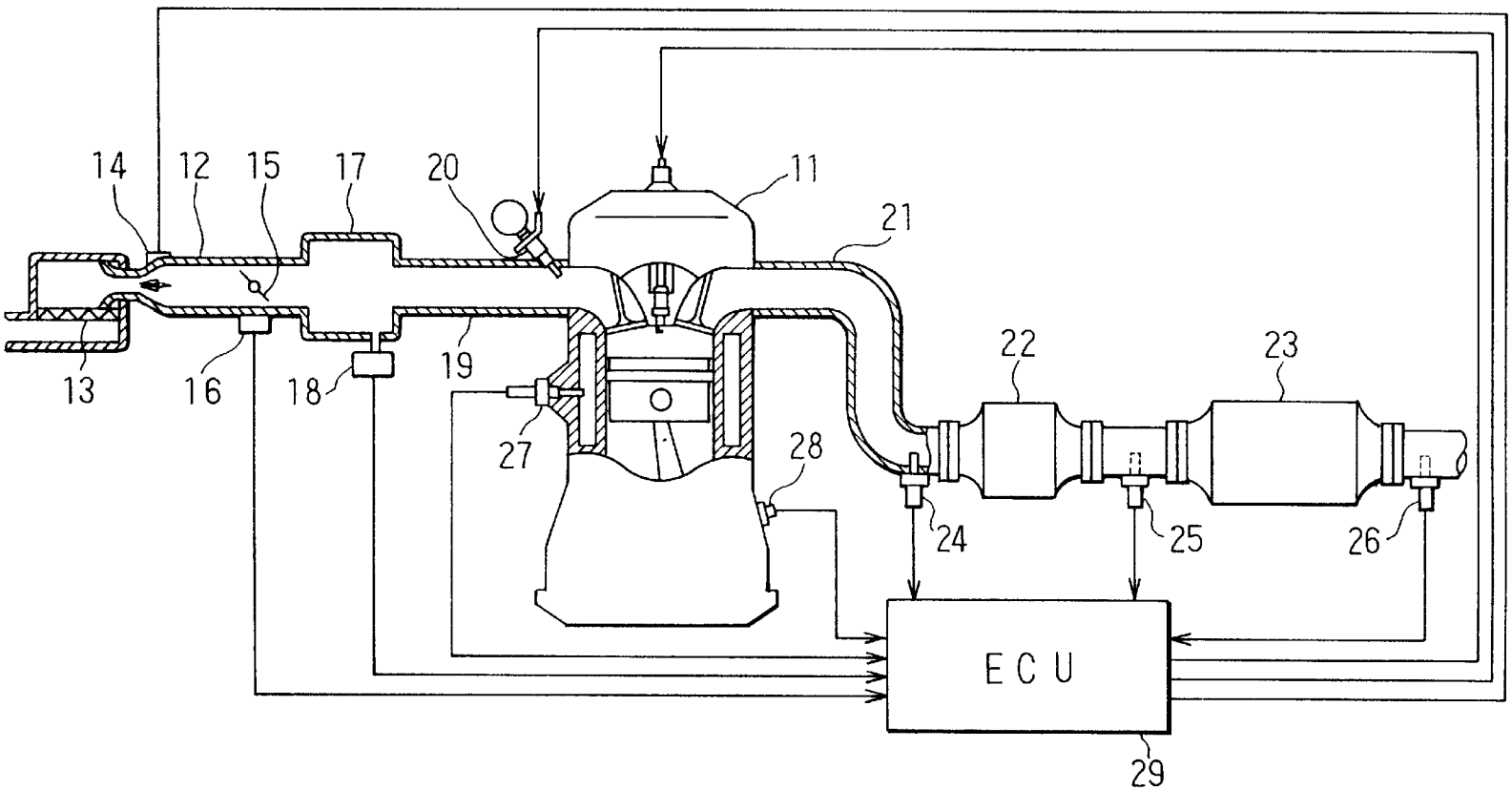
FIG. 1 is a schematic structural diagram of the whole engine control system, according to a first embodiment of the present invention.

Referring first to FIG. 1, an air cleaner 13 is installed in the most upstream portion of an intake pipe 12 of an engine 11 which is an internal combustion engine, and an air flowmeter 14 for detecting the intake air amount is installed downstream of the air cleaner 13. A throttle valve 15 and a throttle angle sensor 16 for detecting the degree of throttle opening angle are installed downstream of the air flowmeter 14.

Furthermore, a surge tank 17 is installed downstream of throttle vale 15, and an intake pipe pressure sensor 18 detecting the intake pipe pressure is installed on the surge tank 17. Moreover, an intake manifold 19 for supplying air into all cylinders of engine 11 is installed on the surge tank 17, and fuel injectors 20 injecting fuel are attached in the vicinity of the intake port of intake manifolds of each cylinder.

On the other hand, an upstream catalyst 22 and a downstream catalyst 23 which decrease the content of toxic components (CO, HC, NOx and the like) in the exhaust gas are disposed in series in the intermediate section of exhaust pipe 21 (exhaust gas passage) of engine 11. In this case, the upstream catalyst 22 is formed to have a relatively small capacity so that the engine warm-up will be rapidly completed when the engine is started and the exhaust gas emission during engine start will be decreased. The downstream catalyst 23 is formed to have a relatively large capacity so that the exhaust gas can be completely purified even in a high-load condition of engine 11 where the amount of exhaust gas increases.

Furthermore, an air-fuel ratio sensor 24 for generating an air-fuel ratio signal linearly corresponding to the air-fuel ratio of the exhaust gas is installed upstream of the upstream catalyst 22, and oxygen sensors 25, 26 whose output voltage VOX2 is changed at stepwise depending on whether the air-fuel ratio of exhaust gas is rich or lean with respect to the stoichiometric air-fuel ratio are installed downstream of the upstream catalyst 22 (upstream of the downstream catalyst 22) and downstream of the downstream catalyst 23, respectively. Moreover, a coolant water temperature sensor 27 for detecting the coolant water temperature and a crank angle sensor 28 for detecting the engine rotation speed NE are mounted on the cylinder block of engine 11.

Outputs of these sensors are input into an engine control unit (ECU) 29. The ECU 29 comprises a microcomputer as the main component and is programmed to feedback control the air-fuel ratio of the exhaust gas by executing programs shown in FIG. 2, FIG. 3, and FIGS. 7 to 10. Those programs are stored in the internal ROM (memory). The processing content of each program will be described below.

Figure 2:
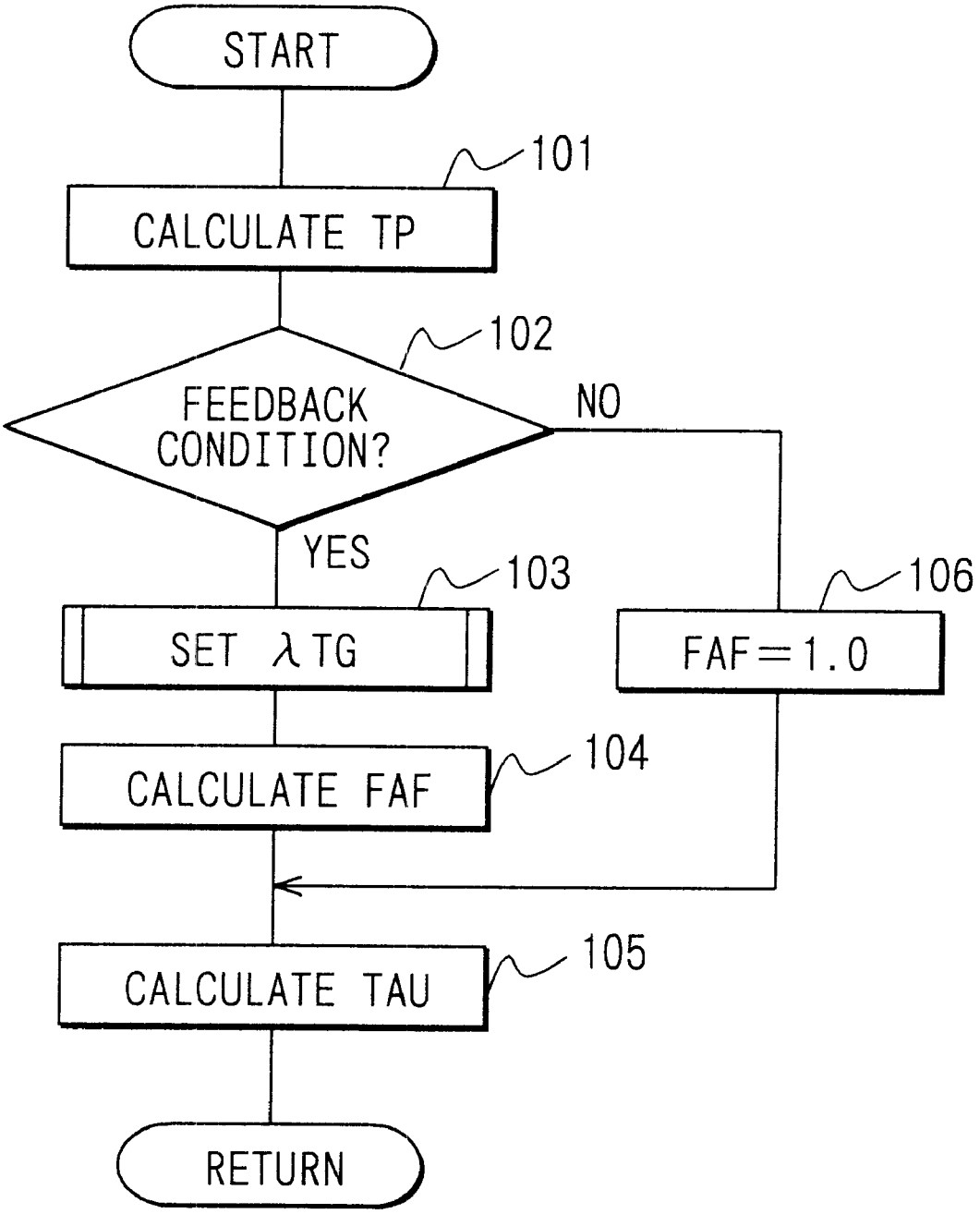
FIG. 2 is a flow chart illustrating processing in a fuel injection amount calculation program of the first embodiment.

The fuel injection amount calculation program shown in FIG. 2 is a program for setting the required fuel injection amount TAU via the feedback control of air-fuel ratio. When executed for each preset crank angle, it starts an air-fuel ratio feedback control. When this program is activated, first, at step 101, the base fuel injection amount TP is calculated based on the operation state parameters such as the intake pipe pressure PM, engine rotation speed NE and the like, and thereafter at step 102, a check is made whether the air-fuel ratio feedback control conditions are fulfilled. Here, the air-fuel ratio feedback conditions include the requirement that the engine cooling water temperature THW be no less than the preset temperature, that the operation state be not in the high speed—high load region, and the like. When all these requirements are met, the air-fuel ratio feedback conditions are fulfilled.

When a determination is made that the air-fuel ratio feedback conditions are not fulfilled at step 102, the program advances to step 106, an air-fuel ratio correction coefficient FAF is set at "1.0" with which no feedback control is effected. In this case, the correction of air-fuel ratio is not conducted.

Figure 3:
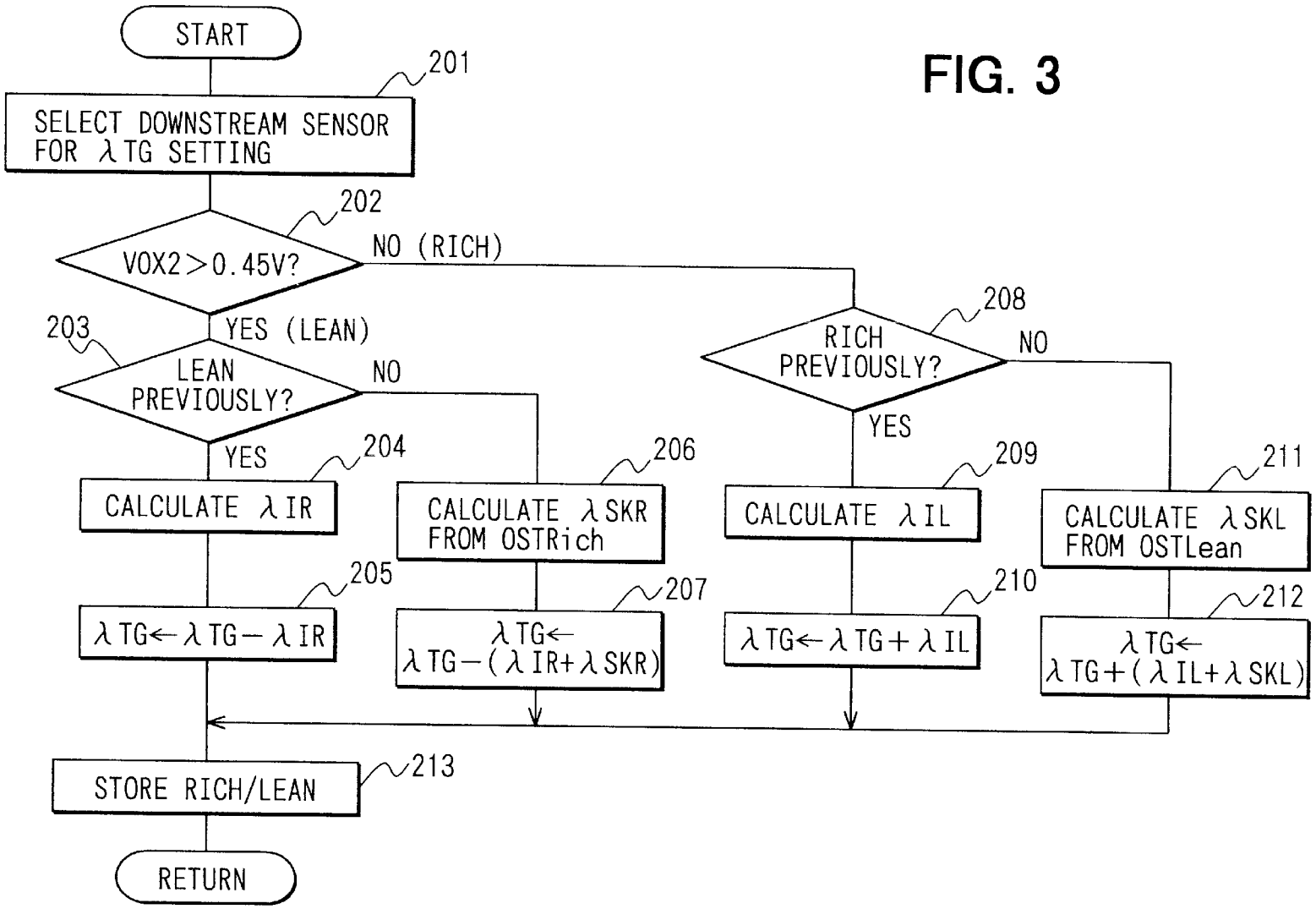
FIG. 3 is a flow chart illustrating processing in a target air-fuel ratio setting program of the first embodiment.
Figure 4:
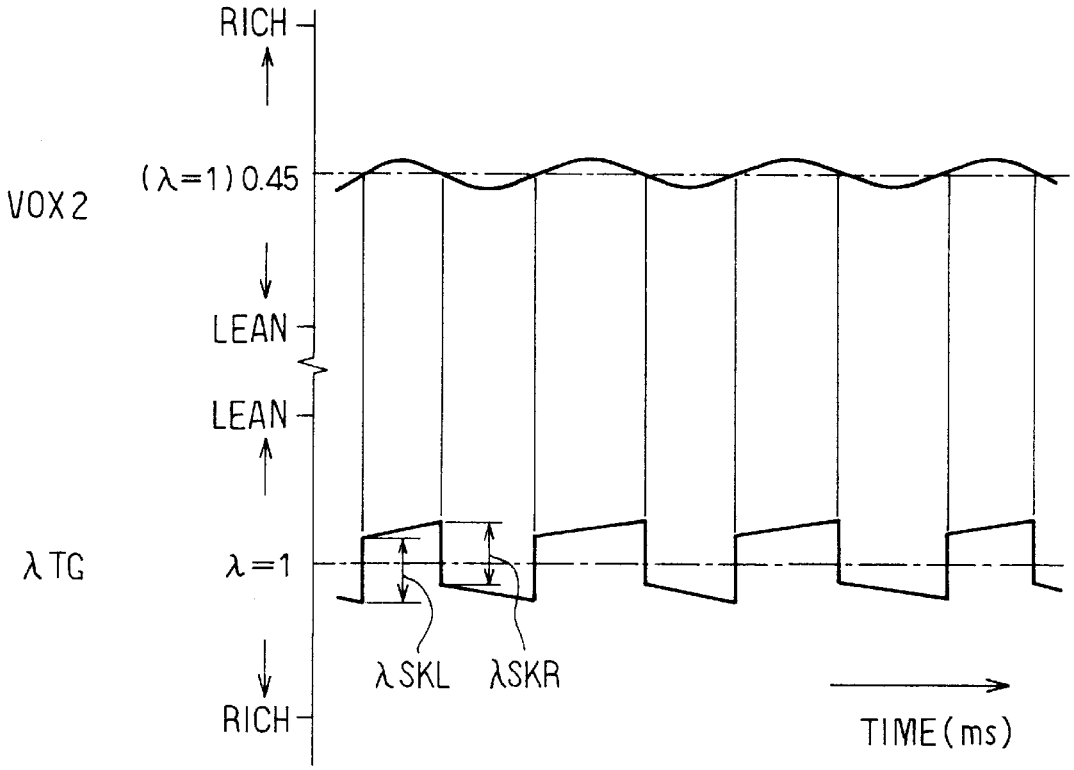
FIG. 4 is a time chart showing the behavior of the oxygen sensor output and target air-fuel ratio in the first embodiment.

On the other hand, when at step 102 a determination is made that the air-fuel ratio feedback conditions are fulfilled, the program advances to step 103, the target air-fuel ratio setting program shown in FIG. 3 is executed so that the target air-fuel ratio λTG is set. In the next step 104, the air-fuel ratio correction coefficient FAF is calculated based on the output λ (air-fuel ratio of exhaust gas) of the air-fuel ratio sensor 24 located upstream of the upstream catalyst 22 and on the target air-fuel ratio λTG.

Thereafter, at step 105, the base fuel injection amount TP, air-fuel ratio correction coefficient FAF, and other correction coefficients FALL are used to calculate the required fuel injection amount TAU by the following formula, and the program is terminated.

$$TAU=TP\times FAF\times FALL.$$

The processing content of the target air-fuel ratio setting program shown in FIG. 3, which is executed at step 103 illustrated in FIG. 2, will be described below. When this program is activated, first, at step 201, the downstream sensor employed for setting the target air-fuel ratio λTG is selected from oxygen sensor 25 installed downstream of the upstream catalyst 22 and oxygen sensor 26 installed downstream of the downstream catalyst 23.

For example, during low-load operation with a small exhaust gas flow rate, the exhaust gas can be substantially purified even with the upstream catalyst 22 alone. Therefore, a better response of the air-fuel ratio control is attained when the oxygen sensor 25 located downstream of the upstream catalyst 22 is employed as the downstream sensor used for setting the target air-fuel ratio λTG. However, when the exhaust gas flow rate increases, the amount of exhaust gas components which pass through without being purified in the upstream catalyst 22 is increased. Therefore, it is necessary to purify the exhaust gas by effectively using both the upstream catalyst 22 and the downstream catalyst 23. In this case, it is preferred that the air-fuel ratio feedback control be conducted which also takes into account the state of the a downstream catalyst 23. Therefore, it is preferred that the oxygen sensor 26 located downstream of the downstream catalyst 23 be used as the downstream sensor used for setting the target air-fuel ratio λTG.

Furthermore, the shorter is the delay time elapsing before the changes in the air-fuel ratio of the exhaust gas discharged from engine 11 (changes in the output of air-fuel ratio sensor 24 located upstream of the upstream catalyst 22) manifest themselves in the output changes of oxygen sensor 25 located downstream of the upstream catalyst 22, the greater is the amount of exhaust gas components passing through without being purified in the upstream catalyst 22 (that is, the purification efficiency is decreased). Therefore, in case of a short delay time of the output changes of oxygen sensor 25, it is preferred that the output of oxygen sensor 26 located downstream of the downstream catalyst 23 be employed as the downstream sensor used for setting the target air-fuel ratio λTG.

The two following conditions are employed for selecting the oxygen sensor 26 located downstream of the downstream catalyst 23 as the downstream sensor used for setting the target air-fuel ratio λTG: (1) the delay time (or period) elapsing before the changes in the air-fuel ratio of the exhaust gas discharged from engine 11 (output changes of air-fuel ratio sensor 24 located upstream of the upstream catalyst 22) manifest themselves in the output changes of oxygen sensor 25 located downstream of the upstream catalyst 22 is shorter than the predetermined time (or predetermined period), or (2) the intake air amount (exhaust gas flow rate) is no less than the predetermined value.

When at least one of these two conditions (1) and (2) is met, the oxygen sensor 26 located downstream of the downstream catalyst 23 is selected. When none of the conditions is satisfied, the oxygen sensor 25 located downstream of the upstream catalyst 22 is selected. Alternatively, when both conditions (1) and (2) are satisfied, the oxygen sensor 26 located downstream of the downstream catalyst 23 may be selected.

Once a downstream sensor for setting the target air-fuel ratio λTG has thus been selected, the program advances to step 202. A determination whether the air-fuel ratio is rich or lean is made based on whether the output voltage VOX2 of the selected oxygen sensor is higher or lower than the target output voltage (for example, 0.45 V) corresponding to the stoichiometric air-fuel ratio (λ=1). If it is YES (lean), the program advances to step 203 and determines whether it was lean in the previous stage. If it is lean in both the previous stage and the present stage, the program advances to step 204. The rich integrated amount λIR is calculated from the map shown in FIG. 5A or 5B according to the current intake air amount QA.

A map for the sensor 25 located downstream of the upstream catalyst (FIG. 5A) and a map for the sensor 26 located downstream of the downstream catalyst (FIG. 5B) are set as the maps of the rich integrated amount λIR, and one of these maps is selected according to the sensor used. Characteristics of the maps of the rich integrated amount λIR shown in FIGS. 5A, 5B are set so that the rich integrated amount λIR decreases with the increase in the intake air amount QA, and so that in the region in which the intake air amount QA is small, the rich integrated amount λIR of the map for the sensor located downstream of the downstream catalyst becomes somewhat higher than that of the map for the sensor located downstream of the upstream catalyst. After the calculation of the rich integrated amount λIR, the program advances to step 205, the target air-fuel ratio λTG is corrected to the rich side by λIR, the respective rich/lean ratio is stored (step 213).

Figure 6:
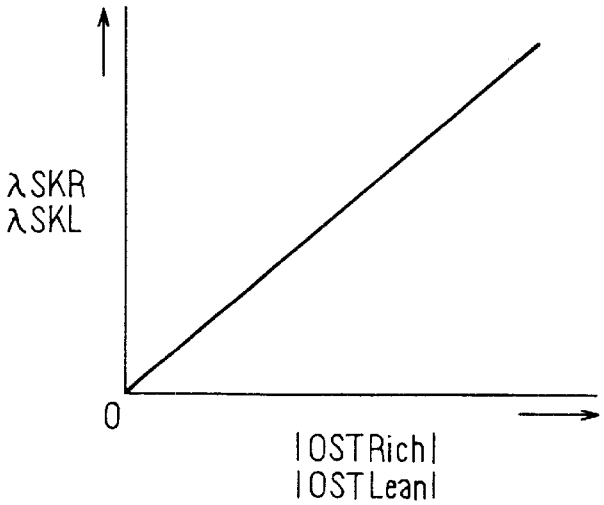
FIG. 6 illustrates a map of a rich proportional amount (lean proportional amount) corresponding to a rich component storage amount (lean component storage amount)

Furthermore, when the rich state in the previous stage is inverted to the lean state of the current stage, the program advances to step 206. The proportional (skip) amount λSKR toward the rich side is determined from the map shown in FIG. 6 according to the rich component storage amount OSTRich obtained by the adsorption amount learning processing described below. Map characteristics shown in FIG. 6 are set so that the rich proportional amount λSKR decreases with the decrease in the absolute value of the rich component storage amount OSTRich. After the calculation of the proportional amount λSKR, the program advances to step 207. The target air-fuel ratio λTG is corrected to the rich side by λIR+λSKR, the respective rich/lean ratio is stored (step 213), and the program is terminated.

On the other hand, when the output voltage VOX2 of the oxygen sensor is rich at step 202, the program advances to step 208 and determines whether the previous stage was also rich. When both the previous stage and the present stage are rich, the program advances to step 209 and the lean integrated value λIL is determined from the map shown in FIG. 5A or 5B according to the current intake air amount QA. A map for the sensor located downstream of the upstream catalyst (FIG. 5A) and a map for the sensor located downstream of the downstream catalyst (FIG. 5B) are set as the maps of the lean integrated amount λIL, and one of these maps is selected according to the sensor selected as the downstream sensor.

Characteristics of the maps of the lean integrated amount λIL shown in FIGS. 5A and 5B are set so that the lean integrated amount λIL decreases with the increase in the intake air amount QA, and so that in the region in which the intake air amount QA is small, the lean integrated amount λIL of the map for the sensor located downstream of the downstream catalyst becomes somewhat higher than that of the map for the sensor located downstream of the upstream catalyst. After the calculation of the lean integrated amount λIL, the program advances to step 210. The target air-fuel ratio λTG is corrected to the lean side by λIL, and the respective rich/lean ratio is stored (step 213).

Furthermore, when the lean state of the previous stage was inverted to the rich state of the current stage, the program advances to step 211. The proportional amount λSKL toward the lean side is determined from the map shown in FIG. 6 according to the lean component storage amount OSTLean obtained by the adsorption amount learning processing described below. Map characteristics shown in FIG. 6 are set so that the lean proportional amount λSKL decreases with the decrease in the lean component storage amount OSTLean. Thereafter, at step 212, the target air-fuel ratio λTG is corrected to the lean side by λIL+λSKL, and the respective rich/lean ratio is stored (step 213).

It is clear from the map shown in FIG. 6 that when the rich component storage amount OSTRich and lean component storage amount OSTLean decreases due to deterioration of catalysts 22, 23, the rich proportional amount λSKL and lean proportional amount λSKL are also gradually set to small values, respectively. As a result, overcorrection exceeding the adsorption limit of catalysts 22, 23 and discharge of toxic components are restricted. The above target air-fuel ratio setting program thus attains a sub-feedback control function.

The storage amount learning processing for calculating the rich component storage amount OSTRich and lean component storage amount OSTLean employed at steps 206, 211 shown in FIG. 3 will be described below. Here, the lean component storage amount OSTLean is the saturated adsorption amount of lean components (NOx, $O_2$ and the like) as a total for both catalysts 22, 23 obtained when the upstream catalyst 22 and downstream catalyst 23 are considered as a single catalyst, and the component storage amount OSTRich is the saturated adsorption amount of rich components (HC, CO and the like) as a total for both catalysts 22, 23 obtained when the upstream catalyst 22 and downstream catalyst 23 are considered as a single catalyst.

Figure 7:
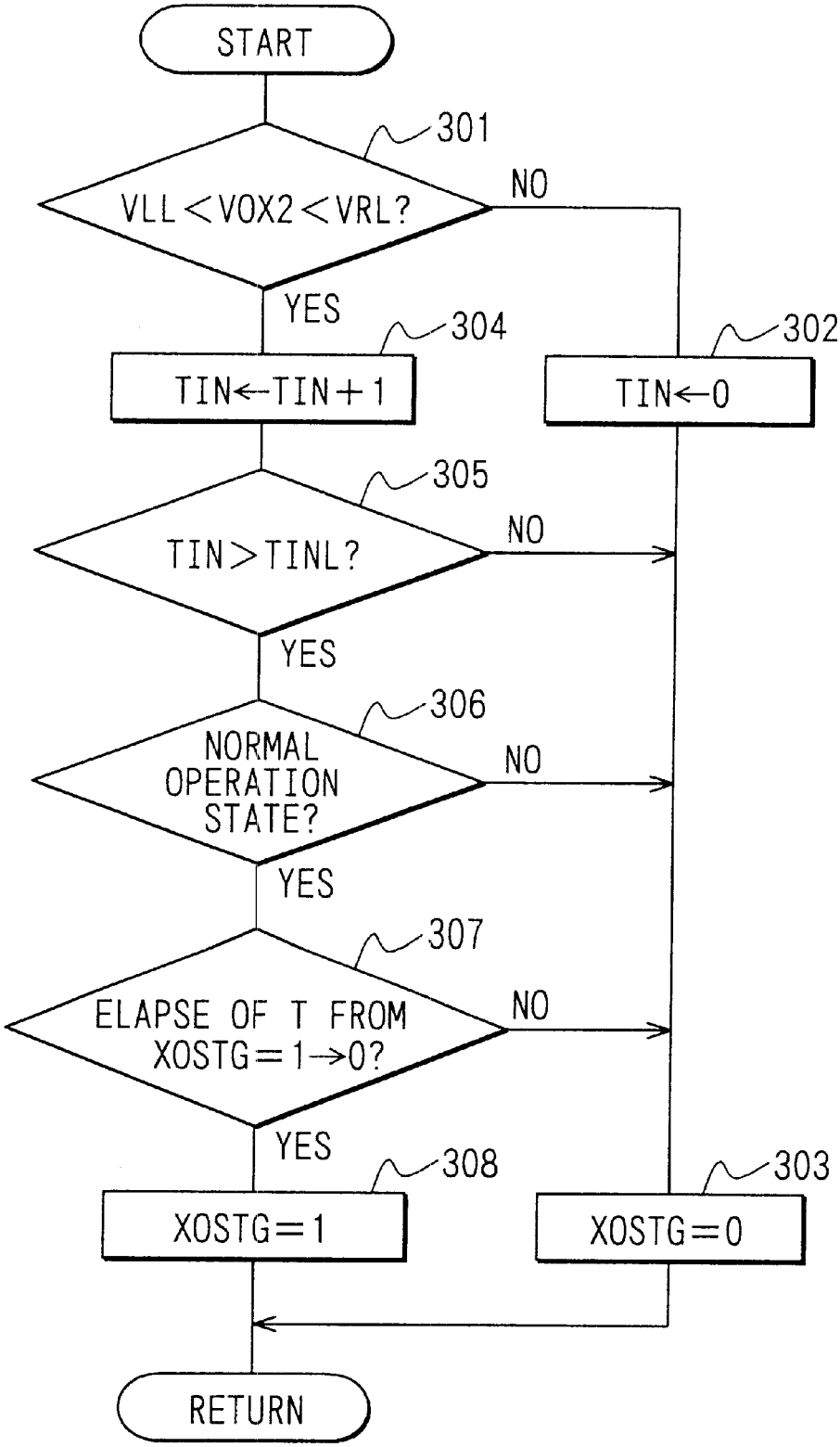
FIG. 7 is a flow chart illustrating processing in a learning initiation determination program of the first embodiment.

ECU 29 executes programs shown in FIGS. 7 to 10, for example, each time a vehicle travel distance reaches the predetermined value. The ECU 29 calculates the rich component storage amount OSTRich and lean component storage amount OSTLean. If the learning initiation determination program shown in FIG. 7 is activated, first, at step 301, a check is made whether the output voltage VOX2 of the oxygen sensor 26 located downstream of the downstream catalyst 23 converges within a range from the lean allowable value VLL to rich allowable value VRL (VLL<VOX2<VRL). When the output voltage VOX2 does not converge within the range between the allowable values VLL and VRL, the air-fuel ratio λ is determined to be disturbed and unsuitable for executing the learning processing of the adsorption amount. The process, thus advancing to step 302, resets a waiting time counter TIN. A learning execution flag XOSTG is cleared in the next step 303.

By contrast, when, at step 301, the output voltage VOX2 of oxygen sensor 26 is found to converge within the range between the allowable values VLL and VRL, the program advances to step 304, and the waiting time counter TIN is incremented by "1". In the next step 305, it is determined whether the value of the waiting time counter TIN exceeded the waiting time TINL. At the instant the TIN becomes greater than TINL, that is, at the instant the retention time of the state with VLL<VOX2<VRL exceeds the waiting time TINL, the program advances to step 306 and a check is made whether the engine 11 is in a normal operation state. The determination is made based on the engine rotation speed NE or intake pipe pressure PM or the like. The engine is determined to be in a normal operation state when these detected values are almost constant. If, in this step 306, the engine is determined to be in a normal operation state, the program advances to step 307 and a check is made whether the learning interval time T has elapsed after the learning execution flag XOSTG was cleared. At the instant the learning interval time T elapses, the program advances to step 308, and the learning execution flag XOSTG is set.

Figure 8:
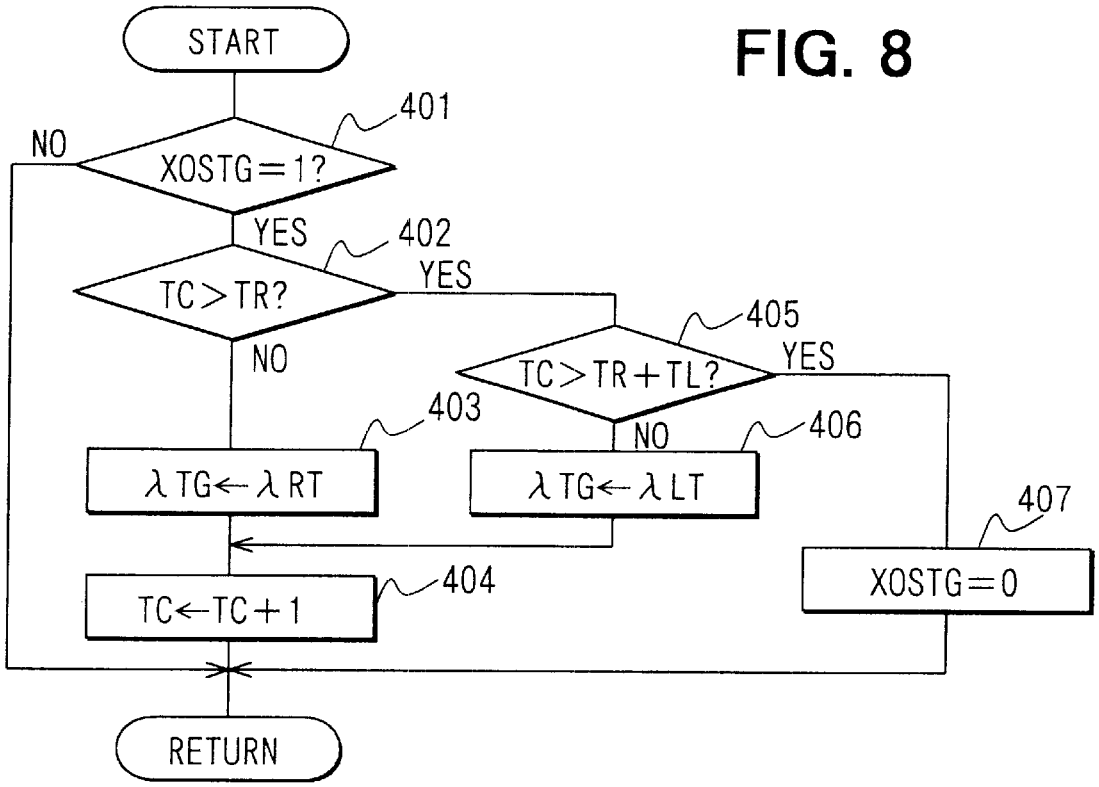
FIG. 8 is a flow chart illustrating processing in a air-fuel ratio variation control program of the first embodiment.
Figure 11:
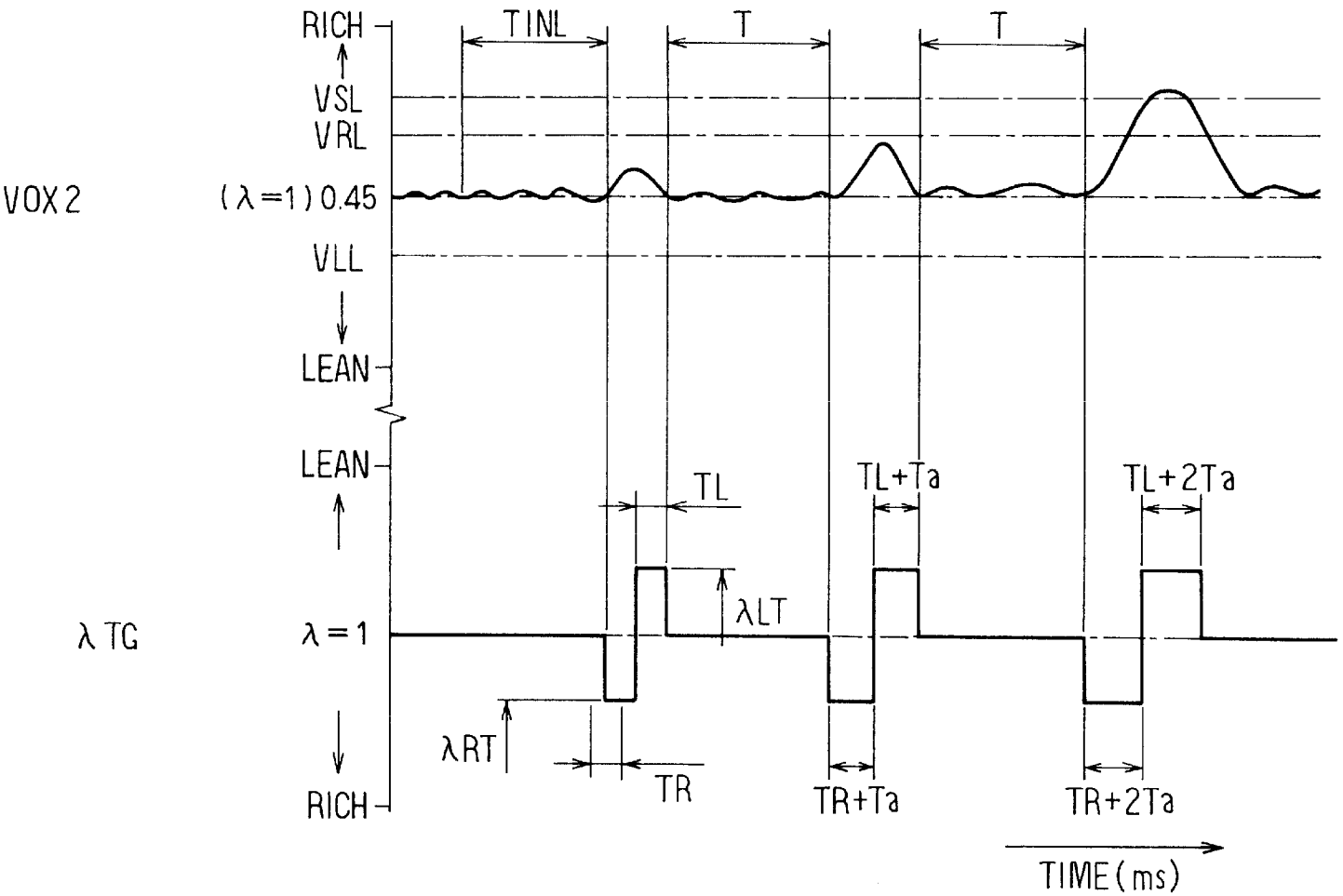
FIG. 11 is a time chart showing the behavior of the oxygen sensor output and target air-fuel ratio during storage amount learning in the first embodiment.

Thereafter, ECU 29 activates the air-fuel ratio variation control program shown in FIG. 8. If the learning execution flag XOSTG was set at step 308 of the above learning initiation determination program shown in FIG. 7, the program advances from step 401 to step 402 to check whether the correction execution counter TC exceeded the rich correction time TR, that is, whether the rich correction time TR has elapsed. If the rich correction time TR has not elapsed, the program advances to step 403 and the target air-fuel ratio λTG is set as the rich target air-fuel ratio λRT. In the next step 404, the correction execution counter Tc is incremented by "1", and the program is terminated. Therefore, as shown in FIG. 11, at step 402, the target air-fuel ratio λTG is maintained at a rich target air-fuel ratio λRT, which is shifted to the rich side from the stoichiometric air-fuel ratio (λ=1), till the rich correction time TR elapses. As a result, the content of rich components such as CO, HC and the like in the exhaust gas is increased, the rich components are adsorbed in catalysts 22, 23, and the output voltage VOX2 of oxygen sensor 26 becomes a voltage on a rich side corresponding to the adsorption amount on catalysts 22, 23.

Thereafter, once the rich correction time TR has elapsed, the program advances from step 402 to step 405. A check is made whether the correction execution counter TC has exceeded the value obtained by adding the lean correction time TL to the rich correction time TR, that is, whether the lean correction time TL has elapsed after the rich correction time TR had elapsed. If the lean correction time TL has not elapsed, the program advances to step 406, and the target air-fuel ratio λTG is set at the lean target air-fuel ratio λTL. At the next step 404, the correction execution counter TC is incremented by "1" and the program is terminated.

Therefore, as shown in FIG. 11, at step 405, till the lean correction time TL elapses, the target air-fuel ratio λTG is maintained at a lean target air-fuel ratio λLT, which is shifted to the lean side from the stoichiometric air-fuel ratio (λ=1), the content of lean components such as $O_2$ in the exhaust gas is increased, the rich components adsorbed in catalysts 22, 23 as a result of the above rich-side correction are purged, and the output voltage VOX2 of oxygen sensor 26 recovers its value close to the stoichiometric air-fuel ratio. Thereafter, at the instant the lean correction time TL elapses, the program advances from step 406 to step 407, and learning execution flag XOSTG is cleared.

Figure 9:
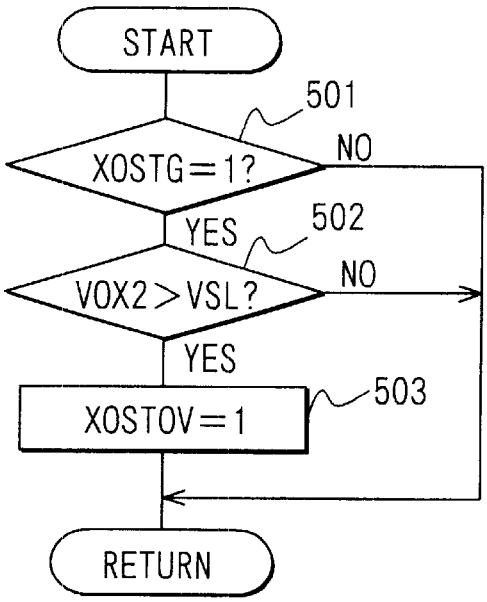
FIG. 9 is a flow chart illustrating processing in a saturation determination program of the first embodiment.

Thereafter, the ECU 29 activates the saturation determination program shown in FIG. 9. If the learning execution flag XOSTG was set at step 308 of the learning initiation determination program shown in FIG. 7, the program advances from step 501 to step 502. A check is made whether the output voltage VOX2 of oxygen sensor 26 has exceeded the saturation determination level VSL (VSL>VRL) as a result of the correction of the target air-fuel ratio λTG to the rich side, which was conducted at step 403 of the air-fuel ratio variation control program shown in FIG. 8. Here, the saturation determination level VSL is set at the output voltage of oxygen sensor 26 obtained when catalysts 22, 23 reaches the saturation state. If the output voltage VOX2 of oxygen sensor 26 does not exceed the saturation determination level VSL, the program is immediately terminated. If the saturation determination level VSL is exceeded, the program advances to step 503, and the saturation determination flag VOSTOV is set.

Figure 10:
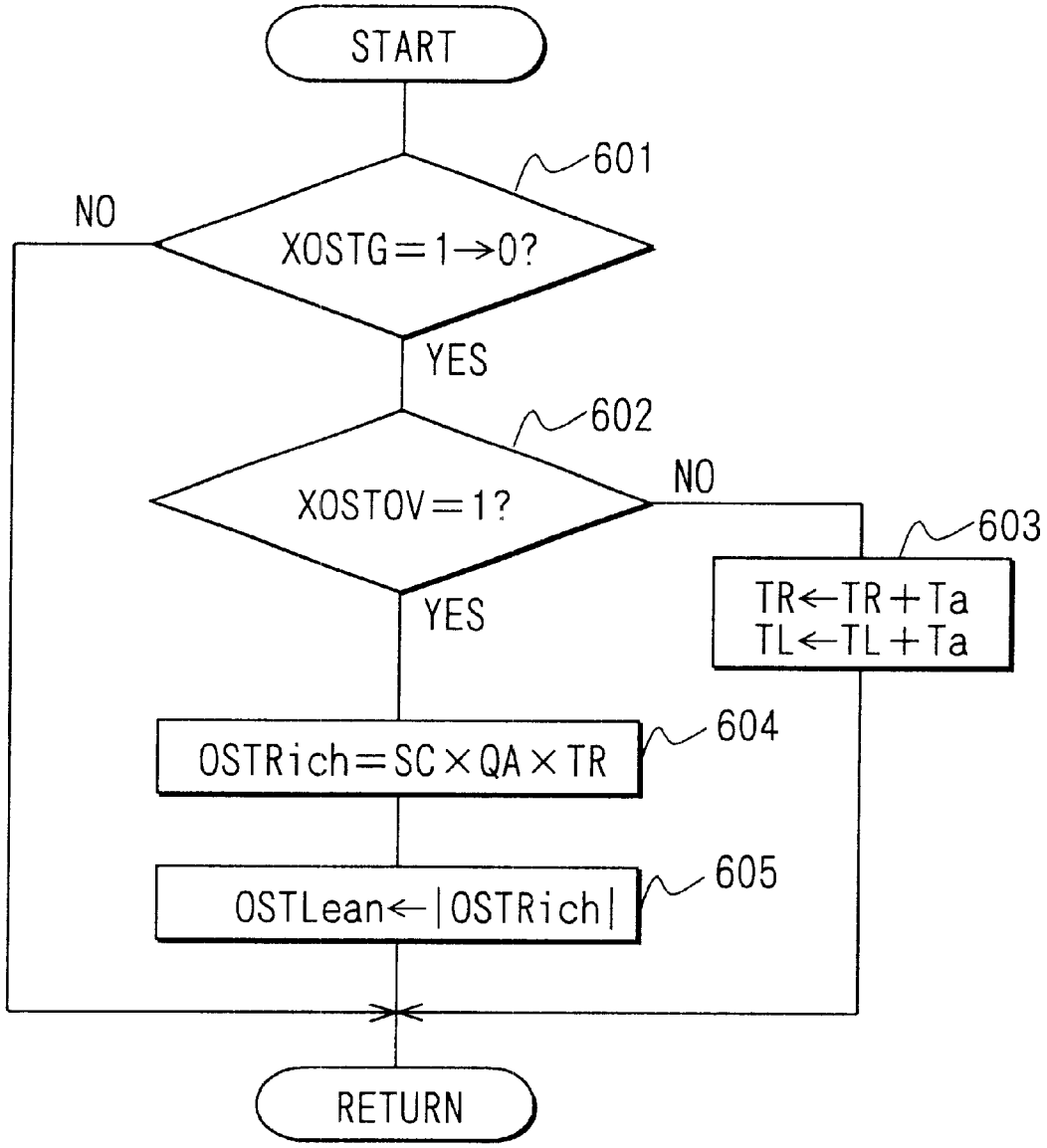
FIG. 10 is a flow chart illustrating processing in a storage amount calculation program of the first embodiment.

Thereafter, ECU29 activates the storage amount calculation program shown in FIG. 10. If the learning execution flag XOSTG is cleared and the variation control of the target air-fuel ratio λTG in one stage is completed at step 407 of the air-fuel ratio variation control program shown in FIG. 8, the program advances from step 601 to step 602. A check is made whether the saturation determination flag VOSTOV was set. If the saturation determination flag VOSTOV was not set, the determination is made that the adsorption limit of catalysts 22, 23 was not exceeded by the variation control of the target air-fuel ratio λTG of the previous stage. The program advances to step 603, and a predetermined addition time Ta is added to the rich correction time TR and lean correction time TL.

As a result, each time a determination is made at step 602 that the saturation determination flag VOSTOV was set, the 125 rich correction time TR and lean correction time TL of the variation control of the target air-fuel ratio λTG, which is executed by the air-fuel ratio variation control program shown in FIG. 8, is extended by the addition time Ta (FIG. 11). If, because of the correction of the target air-fuel ratio λTG to the rich side, the output voltage VOX2 of oxygen sensor 26 exceeds the saturation determination level VSL, and the saturation determination flag VOSTOV is set at step 503 shown in FIG. 9, the program advances from step 602 to step 604, and the current rich component storage amount OSTRich of catalysts 22, 23 is calculated by the following formula by using the substance concentration, intake air amount QA, and rich correction time TR.

$$OSTRich = (\text{substance concentration}) \times QA \times TR.$$

Figure 12:
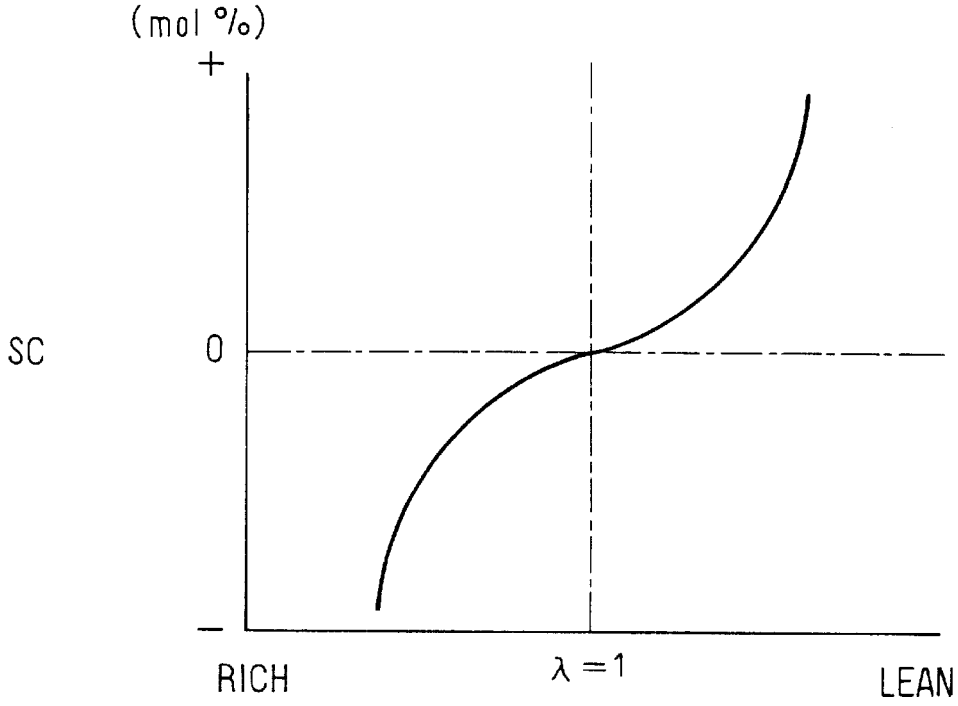
FIG. 12 illustrates an example of the map of exhaust gas substance concentration, in which the air-fuel ratio serves as a parameter.

As for the substance concentration, the substance concentration (SC) corresponding to the rich target air-fuel ratio λRT is calculated by referring to the map of substance concentration employing the air-fuel ratio λ shown in FIG. 12 as a parameter. In the case the air-fuel ratio λ of the exhaust gas has shifted to the rich side, the content of lean components such as NOx, $O_2$ and the like is increased. When the shift was to the lean side, the content of rich components such as CO, HC and the like is increased. However, in the map shown in FIG. 12, the substance concentration (SC) is determined by using $O_2$ as a base. Therefore, in the lean side, the excess amount of $O_2$ is represented by a positive value, and in the rich side, the deficit of $O_2$ necessary for the purification of CO or HC is represented by a negative value. Therefore, the rich component storage amount OSTRich becomes a negative value.

The program then advances to step 605, the absolute value of the rich component storage amount OSTRich is calculated as the lean component storage amount OSTLean, and the program is terminated.

The effect of the air-fuel ratio control conducted in the first embodiment will be described below with reference to FIG. 13 that illustrates an example of control during a high-load operation.

When the exhaust gas flow rate is high, as during a high-load operation, the amount of exhaust gas which passes through without being purified in upstream catalyst 22 is increased, and the amount of exhaust gas purified by downstream catalyst 23 is increased. For this reason, if the air-fuel ratio control is conducted by using the oxygen sensor 25 located downstream of the upstream catalyst 22 as the downstream sensor used for setting the target air-fuel ratio, as shown by the dotted line in FIG. 13, then the air-fuel ratio control reflecting the state of downstream catalyst 23 actually purifying the exhaust gas cannot be conducted. The amount of exhaust gas components adsorbed in downstream catalyst 23 cannot be readily restored to 0, and the exhaust gas purification capacity of downstream catalyst 23 is decreased.

Figure 13:
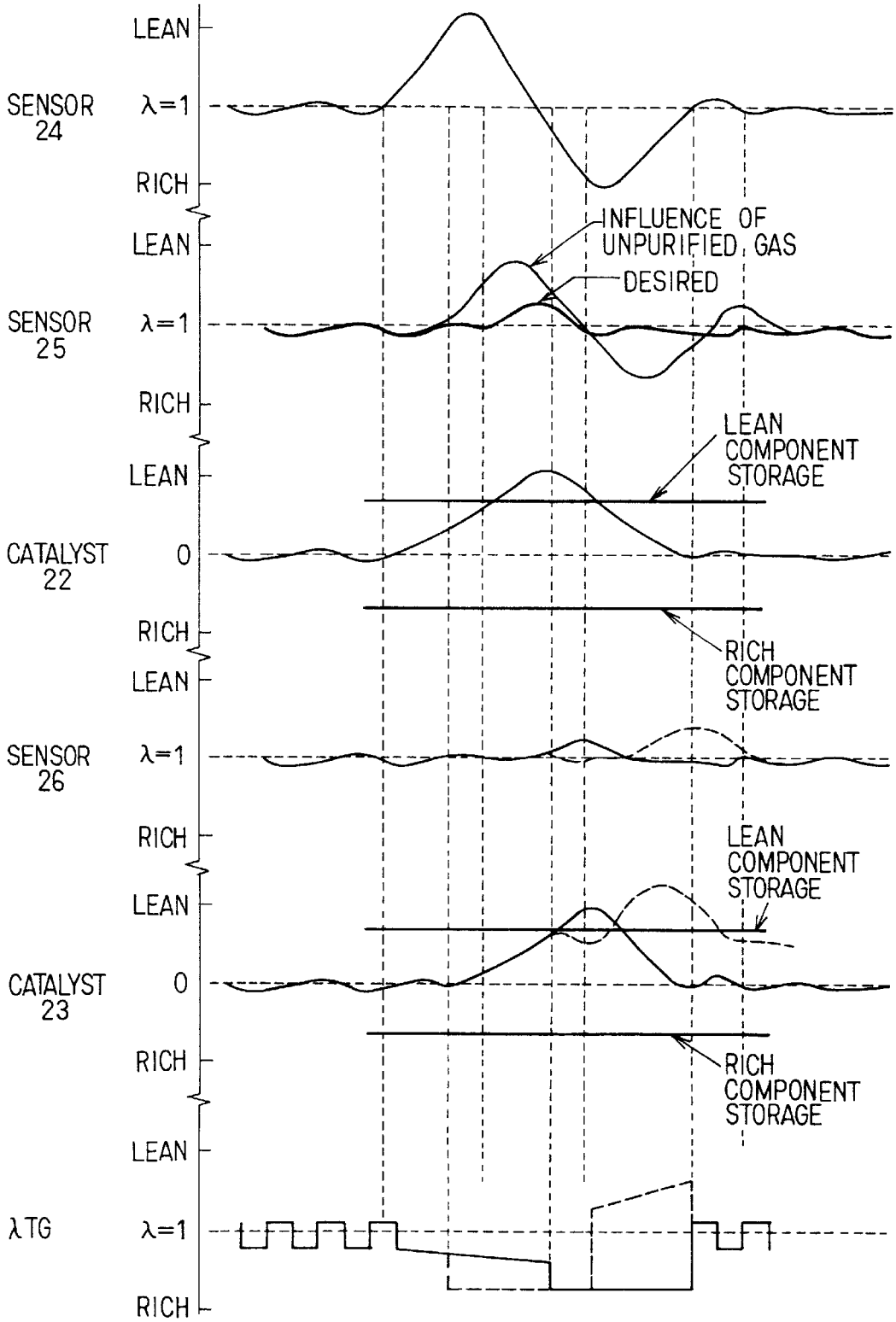
FIG. 13 is a time chart illustrating an example of airfuel ratio control execution in the first embodiment.

By contrast, in the first embodiment, as shown by the solid line in FIG. 13, during high-load operation and the like with a large amount of exhaust gas, the air-fuel ratio control is conducted by switching the downstream sensor used for setting the air-fuel ratio to the oxygen sensor 26 located downstream of the downstream catalyst 23. Therefore, the air-fuel ratio control reflecting the state of downstream catalyst 23 actually purifying the exhaust gas can be conducted and the amount of exhaust gas components adsorbed in downstream catalyst 23 can be rapidly restored to 0. As a result, the exhaust gas purification capacity of downstream catalyst 23 can be fully guaranteed and the exhaust gas can be effectively purified with two catalysts 22, 23 even during high-load operation and the like with a large amount of exhaust gas.

On the other hand, during low-load operation and the like with a small amount of exhaust gas, the air-fuel ratio control is conducted by switching the downstream sensor used for setting the air-fuel ratio to the oxygen sensor 25 located downstream of the upstream catalyst 22, considering the fact that the exhaust gas can be sufficiently purified even with the upstream catalyst 22 alone. Thus, by switching the downstream sensor which is used for setting the air-fuel ratio, according to the engine operation state, it is possible to conduct control of the air-fuel ratio with good response so as to realize fully the exhaust gas purification capacity of the whole catalytic system.

Furthermore, in the first embodiment, rich integrated value λIR or lean integrated value λIL of the air-fuel ratio are changed according to the position of the downstream sensor used for setting the target air-fuel ratio. Therefore, the air-fuel ratio feedback control can be conducted by using the optimum rich integrated value λIR or lean integrated value λIL corresponding to the sensor position.

Furthermore, almost the same effect can be obtained even when the feedback gain is changed according to the position of the downstream sensor used for setting the target air-fuel ratio. However, in accordance with the present invention, the rich integrated value λIR, lean integrated value λIL, and feedback gain may also be fixed values which are not changed as the downstream sensor used for setting the target air-fuel ratio is switched.

Furthermore, in the first embodiment, the target output voltage of the downstream sensor used for setting the target air-fuel ratio is a fixed value (for example, 0.45 V). However, the target output voltage may be changed according to the position of the downstream sensor used for setting the target air-fuel ratio. In such a case, the target output voltage of the downstream sensor used for setting the target air-fuel ratio can be set at an appropriate value according to the position thereof.

(Second Embodiment)

Figure 14:
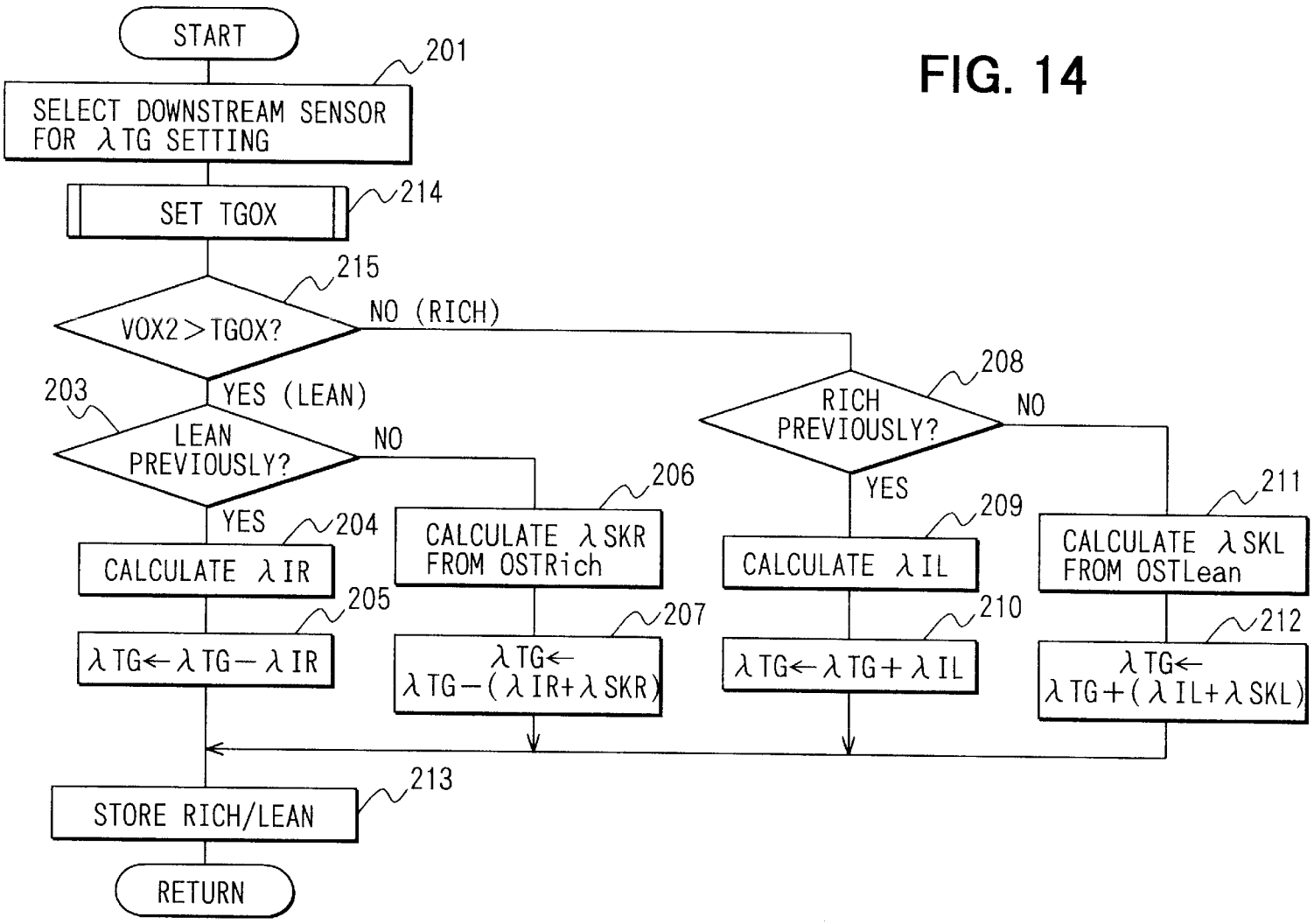
FIG. 14 is a flow chart illustrating processing in a target air-fuel ratio setting program of a second embodiment of the present invention.
Figure 15:
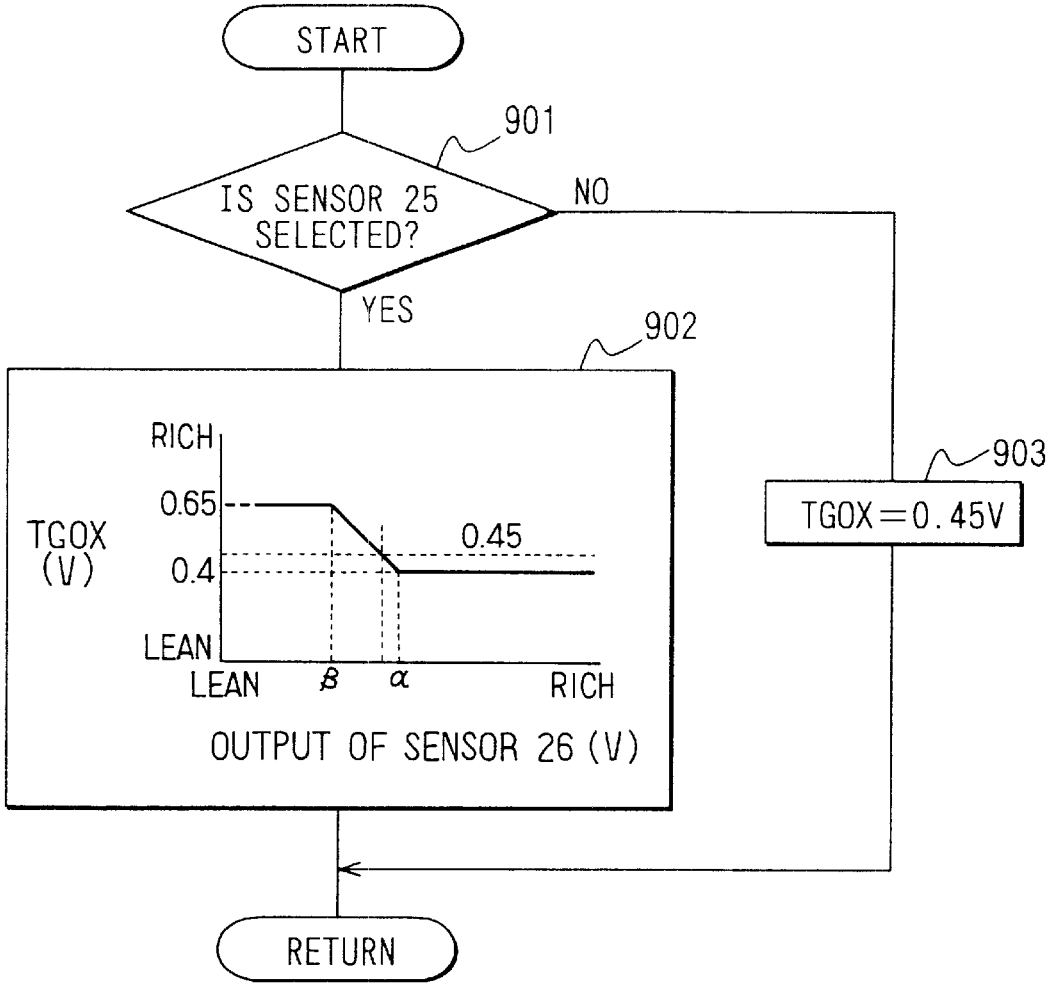
FIG. 15 is a flow chart illustrating processing in a target output voltage setting program of the second embodiment.

In a second embodiment, the ECU 29 executes the target air-fuel ratio setting program shown in FIG. 14 and the target output voltage setting program shown in FIG. 15. When the oxygen sensor 25 located downstream of the upstream catalyst 22 is selected as the downstream sensor used for setting the target air-fuel ratio λTG of the air-fuel ratio setting program, the target output voltage TGOX of the oxygen sensor 25 located downstream of the upstream catalyst 22 is changed according to the output of the oxygen sensor 26 located downstream of the downstream catalyst 23.

In the target air-fuel ratio setting program shown in FIG. 14, first, at step 201, the downstream sensor used for setting the target air-fuel ratio λTG is selected from the oxygen sensor 25 located downstream of the upstream catalyst 22 and the oxygen sensor 26 located downstream of the downstream catalyst 23. Thereafter the program advances to step 214, and the target output voltage setting program shown in FIG. 15 is executed so that the target output voltage TGOX of the downstream sensor used for setting the target air-fuel ratio λTG is set.

Then, the program advances to step 215 to check whether the ratio is rich or lean depending on whether the output voltage VOX2 of the selected oxygen sensor is higher or lower than the target output voltage TGOX. The target air-fuel ratio λTG is calculated according to the results obtained by the method described in the first embodiment with reference to steps 203–213, the respective rich/lean ratio is stored, and the program is terminated.

The processing of the target output voltage setting program shown in FIG. 15, which is executed at step 214 shown in FIG. 14, will be described below. When this program is activated, first, at step 901, a check is made whether the oxygen sensor 25 located downstream of the upstream catalyst 22 was selected as the downstream sensor used for setting the target air-fuel ratio λTG. If the oxygen sensor 25 located downstream of the upstream catalyst 22 was selected as the downstream sensor used for setting the target air-fuel ratio λTG, the program advances to step 902 and the target output voltage TGOX corresponding to the current output voltage of oxygen sensor 26 located downstream of the downstream catalyst 23 is calculated from the map of target output voltage TGOX in which the output voltage of oxygen sensor 26 located downstream of the downstream catalyst 23 serves as a parameter.

In this case, the map of target output voltage TGOX is set so that when the output voltage (air-fuel ratio of the gas flowing out of downstream catalyst 23) of oxygen sensor 26 located downstream of the downstream catalyst 23 is within the predetermined range ($\beta \leqq$ output voltage $\leqq \alpha$) close to the stoichiometric air-fuel ratio, the target output voltage TGOX decreases (becomes lean) as the output of oxygen sensor 26 located downstream of the downstream catalyst 23 increases (becomes rich). Furthermore, settings are such that in the region in which the output of oxygen sensor 26 located downstream of the downstream catalyst 23 is higher than the predetermined value α, the target output voltage TGOX becomes a predetermined lower limit value (for example, 0.4 V), and in the region in which the output of oxygen sensor 26 located downstream of the downstream catalyst 23 is lower than the predetermined value β, the target output voltage TGOX becomes a predetermined upper limit value (for example, 0.65 V). As a result, the target output voltage TGOX of the oxygen sensor 25 located downstream of the upstream catalyst 22 is set within a range such that the amount of the exhaust gas components adsorbed in the downstream catalyst 23 is no higher than the prescribed value, or is set so that the air-fuel ratio of the exhaust gas flowing through the downstream catalyst 23 is within the predetermined range of purification window.

On the other hand, when the oxygen sensor 26 located downstream of the downstream catalyst 23 is selected as the downstream sensor used for setting the target air-fuel ratio λTG, the program advances from step 901 to step 903 and the target output voltage TGOX is set to the predetermined value (for example, 0.45 V). The above target output voltage setting program thus operates to perform the second feedback control.

According to the second embodiment, when the oxygen sensor 25 located downstream of the upstream catalyst 22 is selected as the downstream sensor used for setting the target air-fuel ratio λTG, the target air-fuel ratio λTG (target output voltage of the air-fuel ratio sensor 24 located upstream of the upstream catalyst 22) of the air-fuel ratio feedback control is set by the sub-feedback control according to the output voltage of the oxygen sensor 25 located downstream of the upstream catalyst 22. Moreover, the target output voltage TGOX of the oxygen sensor 25 located downstream of the upstream catalyst 22 is set by the second feedback control according to the output of the oxygen sensor 26 located downstream of the downstream catalyst 23. Therefore, the air-fuel ratio of the exhaust gas flowing through catalysts 22, 23 can be feedback controlled to the appropriate air-fuel ratio corresponding to the exhaust gas purification capacity of the catalysts 22, 23, the exhaust gas purification capacity of the catalysts 22, 23 can be fully realized, and the exhaust gas purification capacity of the whole catalyst system can be increased.

Furthermore, in the second embodiment, by setting the target output voltage TGOX of the oxygen sensor 25 located downstream of the upstream catalyst 22 within a range from 0.4 to 0.65 V, the target output voltage TGOX was set within a range such that the amount of the exhaust gas components adsorbed in the downstream catalyst 23 was no higher than the prescribed value, or was set so that the air-fuel ratio of the exhaust gas flowing through the downstream catalyst 23 was within the predetermined range of purification window. Therefore, overcorrection of the target output voltage TGOX exceeding the adsorption limit of the exhaust gas components of the downstream catalyst 23 or the purification window can be prevented.

Furthermore, the rich proportional amount λSKR and lean proportional amount λSKL (control gain of sub-feedback control) may be changed according to the output of oxygen sensor 26 located downstream of the downstream catalyst 23. In this case, too, the target air-fuel ratio λTG of the air-fuel ratio feedback control can be set according to the output voltage (air-fuel ratio of the gas flowing out of the downstream catalyst 23) of oxygen sensor 26 located downstream of the downstream catalyst 23, and the air-fuel ratio of the gas flowing into the downstream catalyst 23 can be controlled to the appropriate air-fuel ratio corresponding to the current exhaust gas purification efficiency of the downstream catalyst 23.

Furthermore, the control gain of the sub-feedback control can be changed according to the amount of exhaust gas components adsorbed in the upstream catalyst 22, or the control gain of the second feedback control may be changed according to the amount of exhaust gas components adsorbed in the downstream catalyst 23. Since the amount of exhaust gas components adsorbed in catalysts 22, 23 is a parameter suitable for evaluating the exhaust gas purification efficiency of catalysts 22, 23, if the control gain of the sub-feedback control or second feedback control is changed according to the amount of exhaust gas components adsorbed in catalysts 22, 23, it is possible to conduct the air-fuel ratio feedback control reflecting the exhaust gas purification efficiency of the whole catalytic system with good accuracy.

(Third Embodiment)

In a third embodiment, an air-fuel ratio sensor (not shown in the Figures) is disposed instead of the oxygen sensor 25 upstream of the downstream catalyst 23. Other structural components are the same as in the first embodiment. In the third embodiment, ECU29 executes the downstream catalyst adsorption amount evaluation program shown in FIG. 16 to estimate the amount of exhaust gas components adsorbed in the downstream catalyst 23 based on the amount of exhaust gas components adsorbed in the upstream catalyst 22 and the airfuel ratio and intake air amount (exhaust gas flow rate) upstream of downstream catalyst 23, and executes the target air-fuel ratio setting program shown in FIG. 17 to correct the target air-fuel ratio λTG so as to reduce to zero the amount of exhaust gas components adsorbed in the downstream catalyst 23. The processing of each program will be described below.

Figure 16:
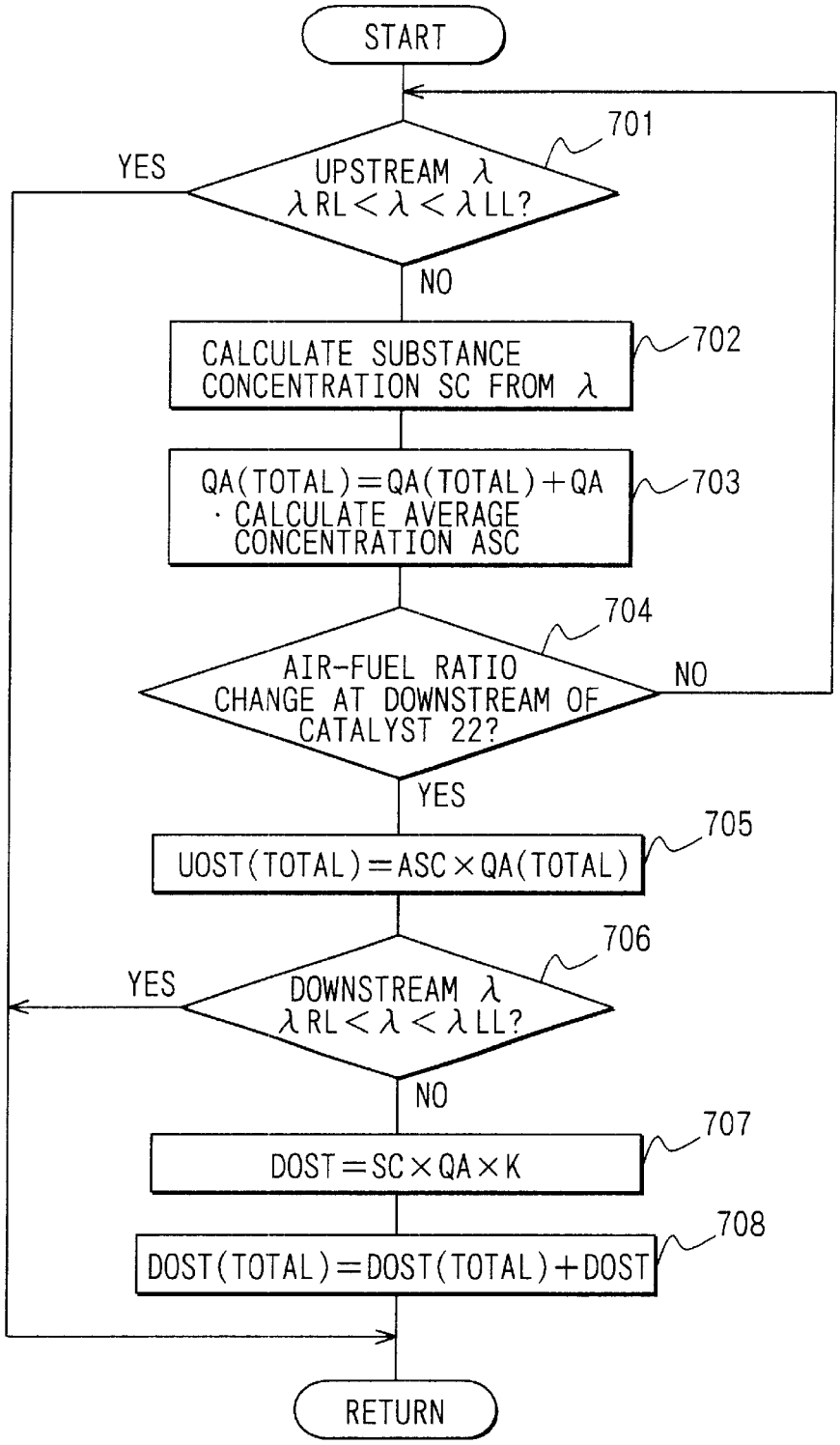
FIG. 16 is a flow chart illustrating processing in a downstream catalyst adsorption amount evaluation program of a third embodiment of the present invention.

In the downstream catalyst adsorption amount evaluation program shown in FIG. 16, first, at step 701, a check is made whether the air-fuel ratio λ detected by the air-fuel ratio sensor 24 located upstream of the upstream catalyst 22 converged within the range between the preset rich allowable value λRL and lean allowable value λLL. When the air-fuel ratio λ upstream of the upstream catalyst 22 converged within the range between the allowable values λRL and λLL, since the air-fuel ratio λ is considered to have been stabilized close to the stoichiometric air-fuel ratio, a determination is made that the amount of exhaust gas components adsorbed in catalysts 22, 23 is almost zero, and the program is terminated without subsequent processing.

On the other hand, when the air-fuel ratio λ upstream of the upstream catalyst 22 did not converge within the range between the allowable values λRL and λLL and was disturbed, the program advances to step 702 and the current substance concentration (SC) of the exhaust gas is calculated from the air-fuel ratio λ upstream of the upstream catalyst 22 by referring to the map of substance concentration of the exhaust gas employing the air-fuel ratio λshown in FIG. 12 as a parameter. Then, the program advances to step 703, and the intake air amount integrated value QA (TOTAL) relating to stages before this stage is determined by adding the intake air amount detected value QA relating to this stage to the integrated value QA (TOTAL) relating to stages before the previous stage.

$$QA(\text{TOTAL})=QA(\text{TOTAL})+QA.$$

Furthermore, the average substance concentration ASC is determined from the average value of the air-fuel ratio λ relating to stages before this stage.

Then, the program advances to step 704 and a check is made whether the air-fuel ratio detected by the air-fuel ratio sensor located downstream of the upstream catalyst 22 (upstream of the downstream catalyst 23) has changed from the vicinity of the stoichiometric air-fuel ratio, for example, by deciding whether the predetermined threshold value was exceeded. If the air-fuel ratio is close to the stoichiometric air-fuel ratio, a determination is made that the amount of exhaust gas components adsorbed in upstream catalyst 22 did not reach the saturation amount (storage amount), the program returns to step 701, and a process of finding the intake air amount integrated value QA(TOTAL) and average substance concentration ASC is repeated.

Then, at the instant the air-fuel ratio downstream of the upstream catalyst 22 changes from the vicinity of the stoichiometric air-fuel ratio, a determination is made that the amount of exhaust gas components adsorbed in the upstream catalyst 22 reached the saturation amount (storage amount), the program advances to step 705, and the exhaust gas component adsorption amount UOST(TOTAL) of upstream catalyst 22 is determined by multiplying the average substance concentration ASC by the intake air amount integrated value QA(TOTAL).

$$UOST(\text{TOTAL})=ASC\times QA(\text{TOTAL}).$$

Then, the program advances to step 706 and a check is made whether the air-fuel ratio λ detected by the oxygen sensor located upstream of the downstream catalyst 23 converged within a range from the rich allowable value λRL and lean allowable value λLL. If the air-fuel ratio λ detected by the oxygen sensor located upstream of the downstream catalyst 23 converged within a range between the allowable values λRL and λLL, the determination is made that the amount of the exhaust gas components adsorbed in the downstream catalyst 23 is small and the program is terminated.

On the other hand, when the air-fuel ratio λ upstream of the downstream catalyst 23 did not converge within the range between the allowable values λRL and λLL and was disturbed, the determination is made that the amount of the exhaust gas components adsorbed in the downstream catalyst 23 is large. The program advances to step 707 and the variation DOST in the amount of the exhaust gas components adsorbed in the downstream catalyst 23 at this stage is calculated by the following formula by using the substance concentration of the exhaust gas determined from the air-fuel ratio λ upstream of the downstream catalyst 23, and also by using the intake air amount detected value QA and a correction coefficient K.

$$DOST=SC\times QA\times K.$$

Here, the correction coefficient K is a correction coefficient used for correcting the effect produced by the amount of the exhaust gas components adsorbed in the upstream catalyst 22 on the amount of the exhaust gas components adsorbed in the downstream catalyst 23. It is determined as a function of catalyst specifications such as the exhaust gas component adsorption amount UOST(TOTAL) of upstream catalyst 22, the capacity of upstream catalyst 22 and downstream catalyst 23, supported noble metal, surface area and the like.

Then, the program advances to step 708, and the adsorption amount DOST(TOTAL) of downstream catalyst 23 is determined by adding the adsorption amount variation DOST relating to this stage to the integrated value DOST (TOTAL) relating to stages before the previous stage.

$$DOST(\text{TOTAL})=DOST(\text{TOTAL})+DOST.$$

Figure 17:
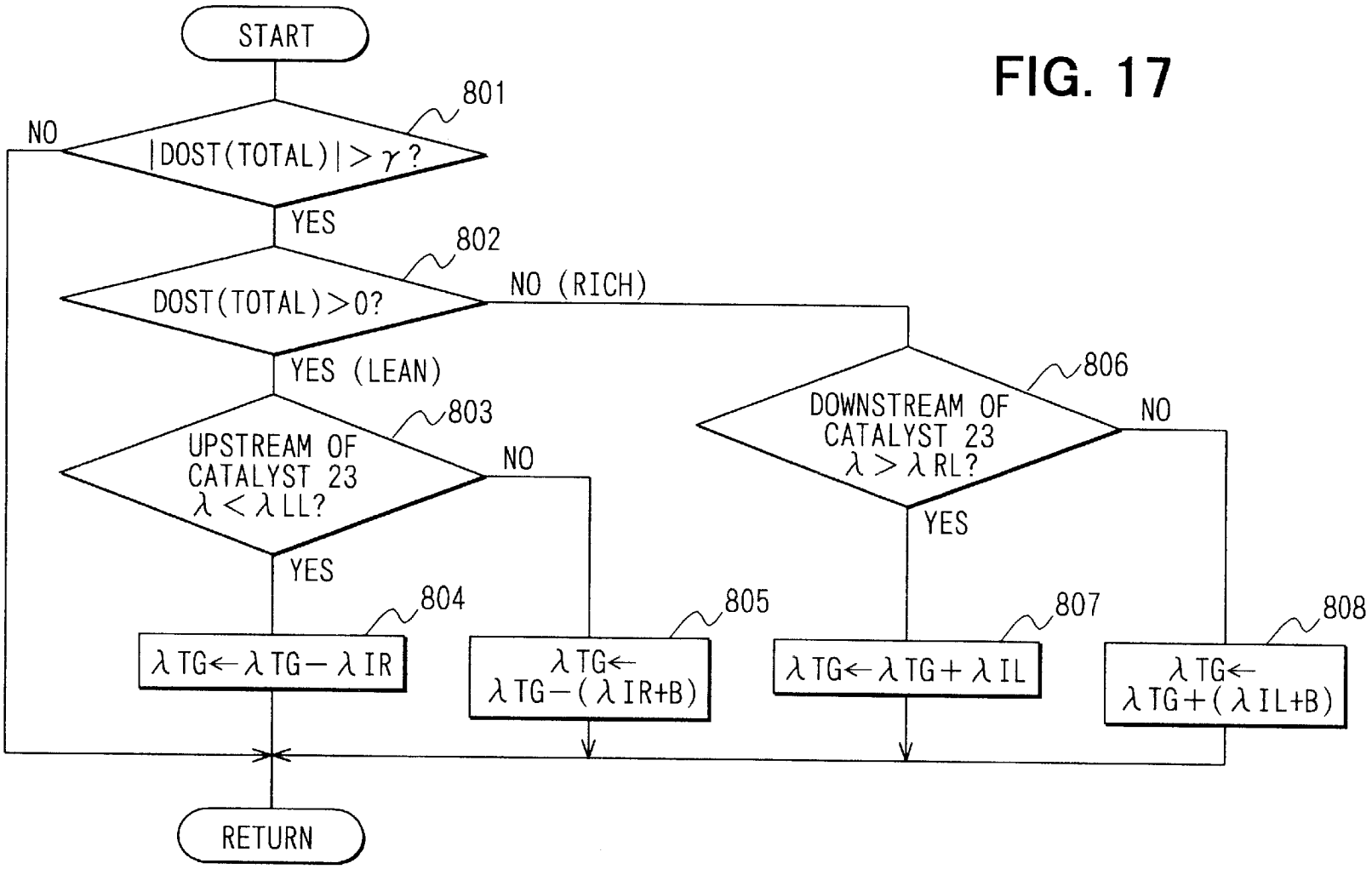
FIG. 17 is a flow chart illustrating processing in a target air-fuel ratio setting program of the third embodiment.

In the target air-fuel ratio setting program shown in FIG. 17, first, at step 801, a check is made whether the absolute value of the adsorption amount DOST(TOTAL) of downstream catalyst 23 is higher than a predetermined reference value γ. If the absolute value of the adsorption amount DOST(TOTAL) of downstream catalyst 23 is no less than the predetermined value, a determination is made that it is not necessary to change the target air-fuel ratio λTG, and the program is terminated without conducting the subsequent processing.

On the other hand, when a determination is made that the adsorption amount DOST(TOTAL) of downstream catalyst 23 is higher than the predetermined value, the program advances to step 802, and a check is made whether the state of downstream catalyst 23 shifted to the lean side or to the rich side, depending on whether the adsorption amount DOST(TOTAL) of downstream catalyst 23 is greater than zero or not. If the state of downstream catalyst 23 shifted to the lean side, the program advances to step 803, a check is made whether the air-fuel ratio λ upstream of the downstream catalyst 23 is within the range of the lean allowable value λLL (λ<λLL), and if the air-fuel ratio λ upstream of the downstream catalyst 23 is within the range of the lean allowable value λLL, the program advances to step 804 and the target air-fuel ratio λTG is corrected to the rich side by the rich integrated value λIR.

On the other hand, when the air-fuel ratio λ upstream of the downstream catalyst 23 shifted to the lean side above the lean allowable value λLL, the program advances to step 805 and the target air-fuel ratio λTG is corrected to the rich side by the value (λIR+B) obtained by adding the predetermined value B to the rich integrated value λIR. Here, the predetermined value B is set within a range in which the amount of the exhaust gas components adsorbed in the downstream catalyst 23 does not exceed the combined rich component storage amount OSTRich (or lean component storage amount OSTLean) of both catalysts 22, 23 as a result of correction of the target air-fuel ratio λTG. In this case, the predetermined value B may be a fixed value, but it also may be changed according to the air-fuel ratio upstream of the downstream catalyst 23.

Furthermore, at step 802, when a determination is made that the state of downstream catalyst 23 has shifted to the rich side, the program advances to step 806, a check is made whether the air-fuel ratio λ upstream of the downstream catalyst 23 is within the range of the rich allowable value λLR (λ<λLR), and if the air-fuel ratio λ upstream of the downstream catalyst 23 is within the range of the rich allowable value λLR, the program advances to step 807, and the target air-fuel ratio λTG is corrected to the lean side by the lean integrated value λIL.

On the other hand, when the air-fuel ratio λ upstream of the downstream catalyst 23 shifted to the rich side to no less than the rich allowable value λRL, the program advances to step 808, and the target air-fuel ratio λTG is corrected to the lean side by the value (λIL+B) obtained by adding the predetermined value B to the lean integrated value λIL. In such a manner, the target air-fuel ratio λTG is corrected so that the exhaust gas component adsorption amount DOST of downstream catalyst 23 becomes zero. The downstream catalyst adsorption amount evaluation program shown in FIG. 16 and the target air-fuel ratio setting program shown in FIG. 17 thus operates to perform the feedback control correction.

Figure 18:
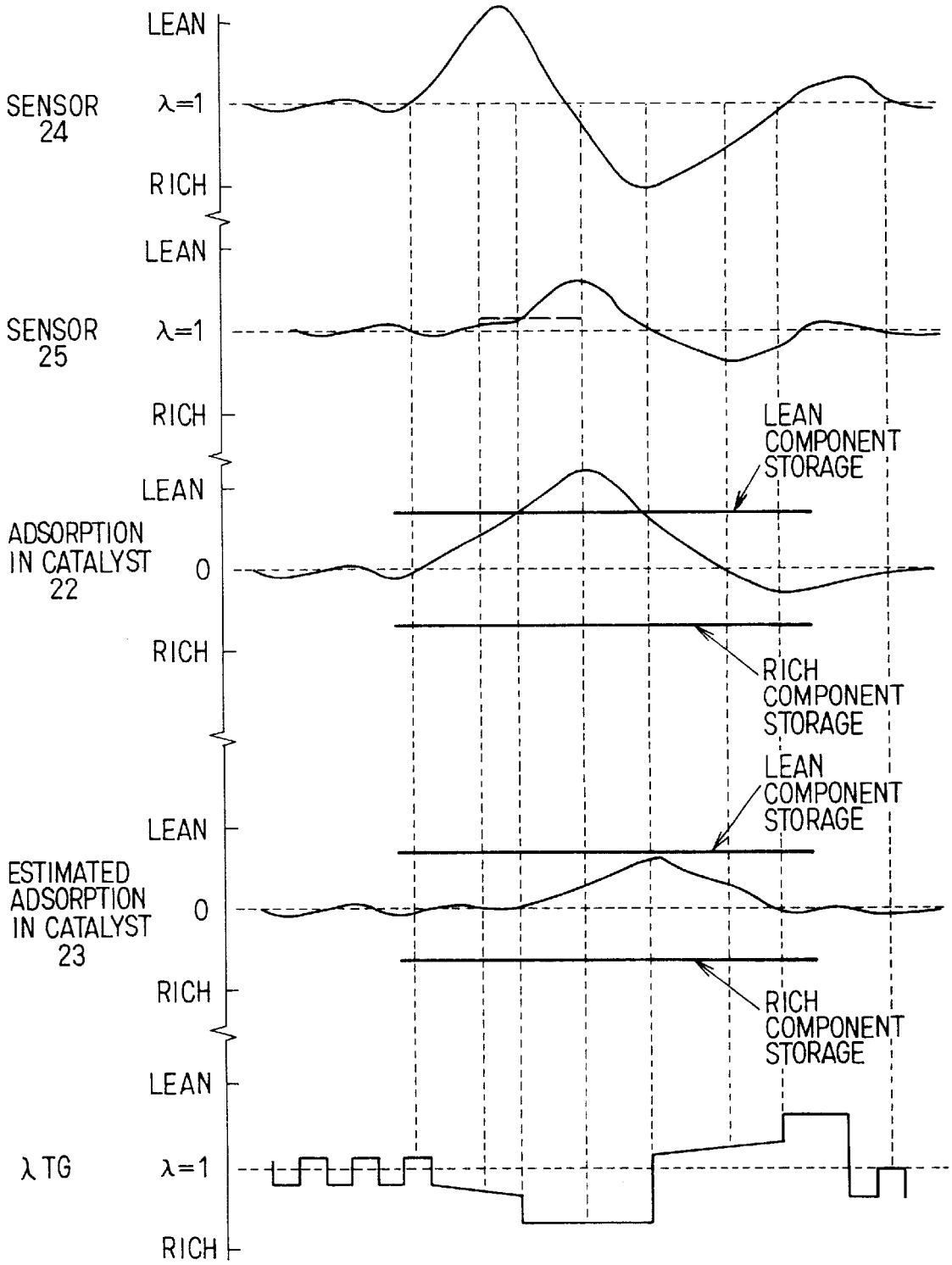
FIG. 18 is a time chart illustrating an example of airfuel ratio control execution in the third embodiment.

In the third embodiment, the exhaust gas component adsorption amount DOST of downstream catalyst 23 is evaluated based on the exhaust gas component adsorption amount UOST of upstream catalyst 22, the air-fuel ratio upstream of downstream catalyst 23, and the intake air amount. The target air-fuel ratio λTG is corrected so that the exhaust gas component adsorption amount DOST becomes zero. Therefore, as shown in FIG. 18, even if the deviation of the air-fuel ratio of exhaust gas has occurred, the amount of exhaust gas components adsorbed in downstream catalyst 23 can be rapidly restored to zero, and the exhaust gas purification efficiency can be increased by effectively using the downstream catalyst 23.

Furthermore, in the third embodiment, the predetermined value B correcting the target air-fuel ratio λTG is set within a range in which the amount of the exhaust gas components adsorbed in the downstream catalyst 23 does not exceed the combined rich component storage amount OSTRich (or lean component storage amount OSTLean) of both catalysts 22, 23 as a result of correction of the target air-fuel ratio λTG. Therefore, the exhaust gas purification capacity of the whole catalytic system can be realized to its maximum within a range in which the adsorption limits of catalysts 22, 23 are not exceeded.

In the above first to third embodiments, it is possible that no less than three catalysts are disposed in a row inside the exhaust pipe 21 and the respective sensors are disposed upstream and downstream of the catalysts.

(Fourth Embodiment)

Figure 19:
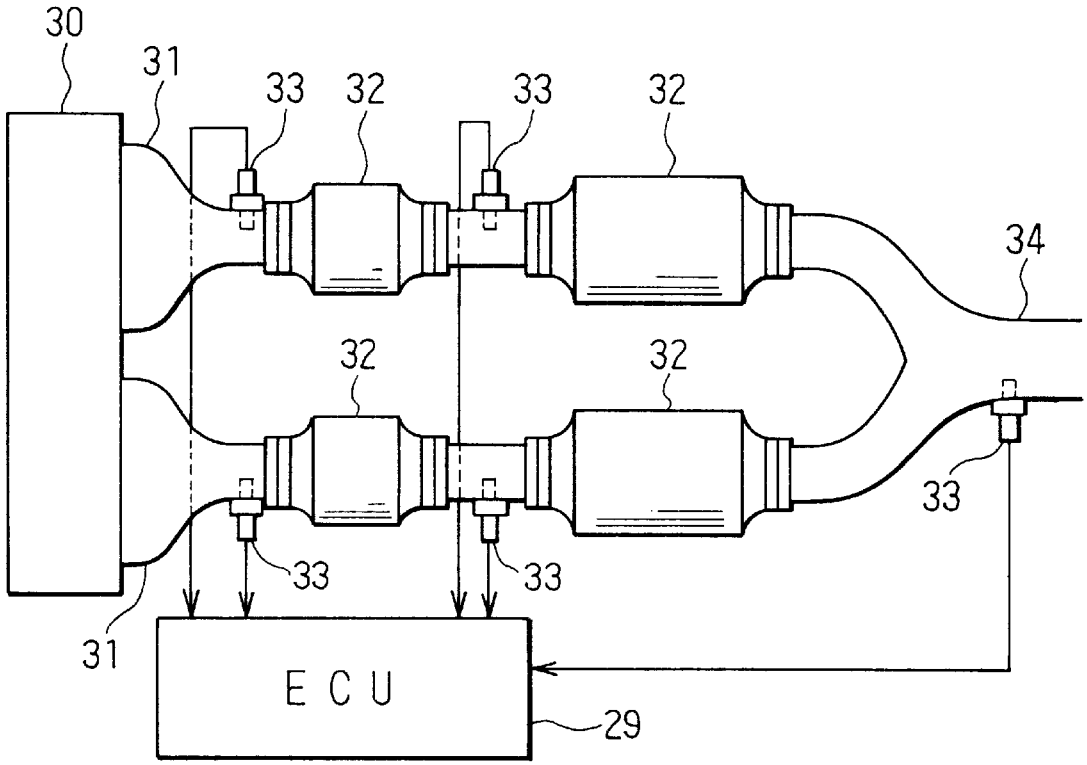
FIG. 19 is a schematic structural diagram of an exhaust system, illustrating a fourth embodiment of the present invention.

In a fourth embodiment, as shown in FIG. 19, one or a plurality of catalysts 32 are disposed in each exhaust pipe installed individually for each group of cylinders (for example, each bank of a V-type engine) of engine 30, and respective sensors 33 such as air-fuel ratio sensors or oxygen sensors and the like are disposed upstream and downstream of catalysts 32. The sensor 33 located downstream of the most downstream catalysts 32 in the exhaust pipes 31 of each group of cylinders can be disposed and made common in a collective exhaust pipe 34 (collective exhaust passage) where the exhaust gases from exhaust pipes of all groups of cylinders are combined. With such a structure, the gas concentration or air-fuel ratio downstream of the most downstream catalyst 32 in the exhaust pipe 31 of each group of cylinders can be detected with a common sensor 33, the number of sensors 33 can be decreased, and the cost can be reduced. It is also possible that the sensor 33 located downstream of the most downstream catalyst 32 in the exhaust pipe 31 of each group of cylinders may be disposed in each exhaust pipe 31 of each group of cylinders.

Figure 20A:
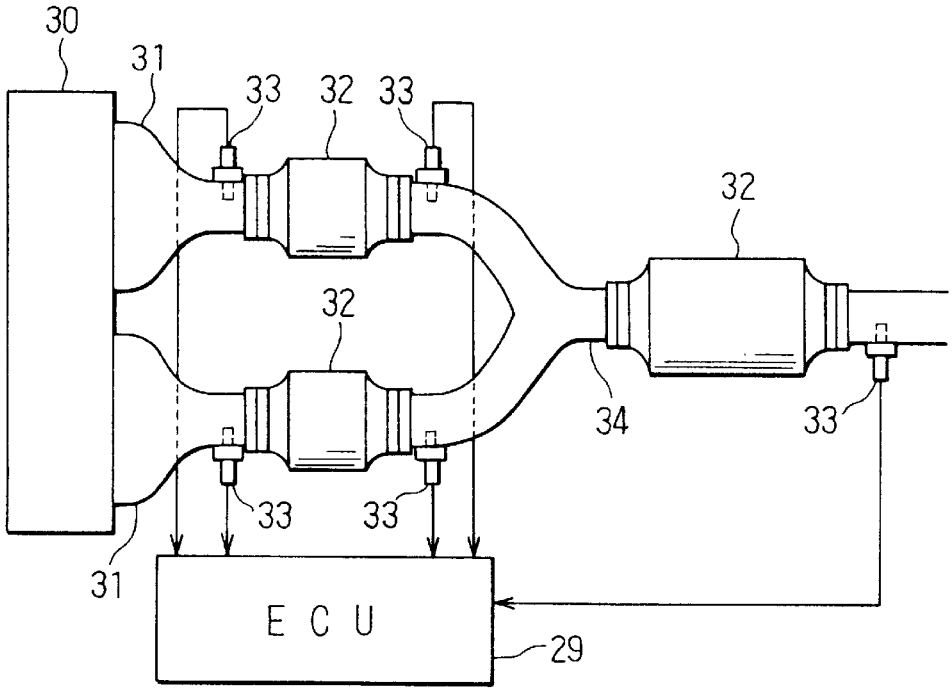
FIGS. 20A and 20B are schematic structural diagrams of the exhaust systems as a modification of the fourth embodiment with different locations of sensors arranged downstream of catalysts in the exhaust pipe of each group of cylinders.
Figure 20B:
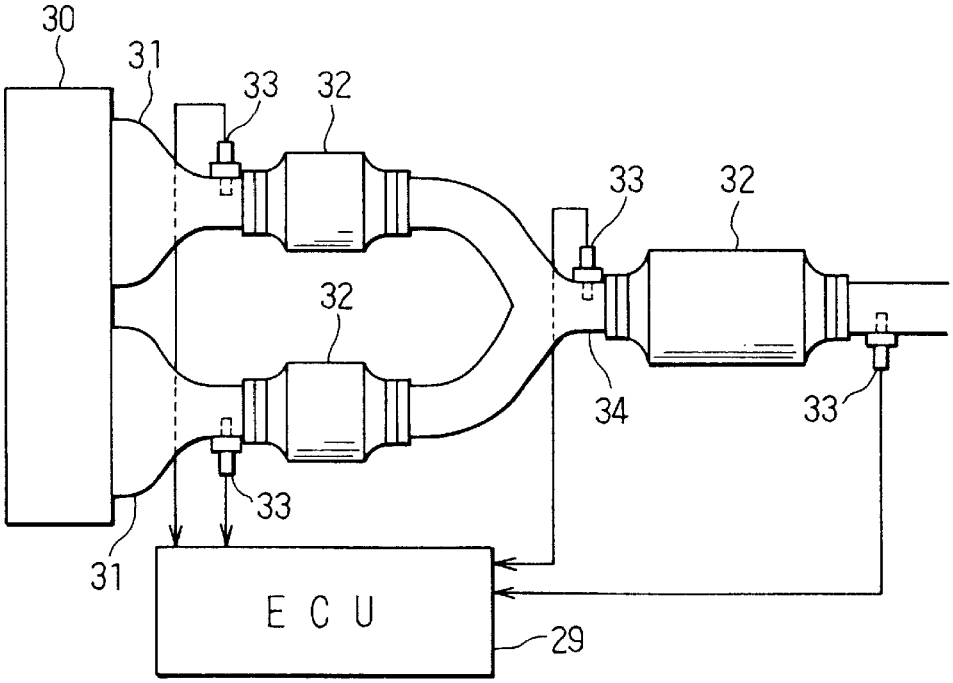

Furthermore, it is possible as shown in FIGS. 20A and 20B that the upstream catalysts 32 are disposed in each exhaust pipe 31 of each group of cylinders of engine 30, and the downstream catalyst 32 is also disposed in the collective exhaust pipe 34. In this case, as shown in FIG. 20A, sensors 33 located downstream of catalyst 32 of exhaust pipes 31 of each group of cylinders may be disposed in each exhaust pipe 31 of each group of cylinders. Alternatively, as shown in FIG. 20B, the sensor 33 located downstream of catalysts 32 of exhaust pipes 31 of each group of cylinders may be disposed in the collective exhaust pipe 34. With any of the structures shown in FIGS. 20A and 20B, the catalysts 32 of exhaust pipe 31 of each group of cylinders and catalyst 32 of the collective exhaust pipe 34 can be used with good efficiency and the exhaust gas purification capacity can be increased.

(Fifth Embodiment)

Figure 21A:
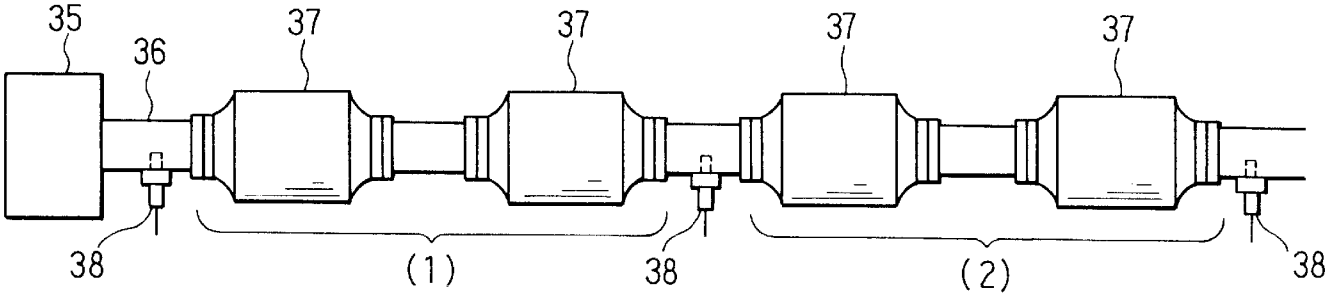
FIGS. 21A–21C are schematic structural diagrams of the exhaust systems of a fifth embodiment of the present invention with different methods of dividing catalysts into groups.
Figure 21B:
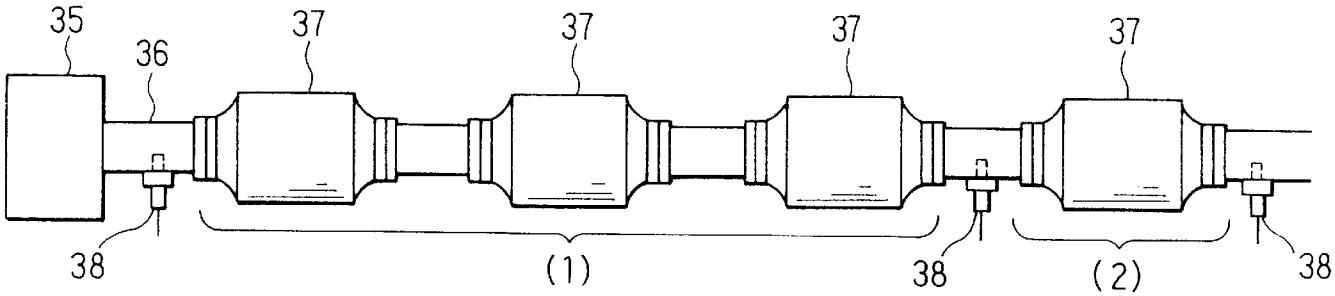
Figure 21C:
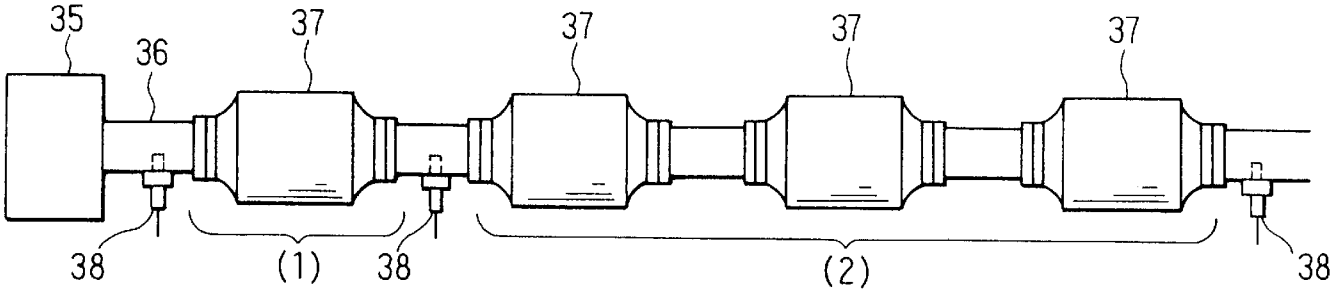

In a fifth embodiment shown in FIGS. 21A to 21C, no less than three (for example, four) catalysts 37 are disposed in series in an exhaust pipe 36 of engine 35. In this case, as shown in FIG. 21A, the catalysts 37 are divided into a group of catalysts (1) including two upstream catalysts 37 and a group of catalysts (2) including two catalysts 37 located downstream thereof. Each group of catalysts is considered as a single catalyst, and sensors 38 such as air-fuel ratio sensors or oxygen sensors and the like are disposed upstream and downstream of each group of catalysts 37.

Further, the method for dividing the catalysts 37 into groups may be changed appropriately according to the control object and the like. Specifically, as shown in FIG. 21B, the catalysts 37 may be divided into a group of catalysts (1) including three upstream catalysts 37 and a group of catalysts (2) including one catalyst 37 located downstream thereof, and respective sensors 38 may be disposed upstream and downstream of each group of catalysts. Alternatively, as shown in FIG. 21C, the catalysts 37 may be divided into a group of catalyst (1) including one upstream catalyst 37 and a group of catalysts (2) including three catalysts 37 located downstream thereof, and respective sensors 38 may be disposed upstream and downstream of each group of catalysts.

(Sixth Embodiment)

Figure 22A:
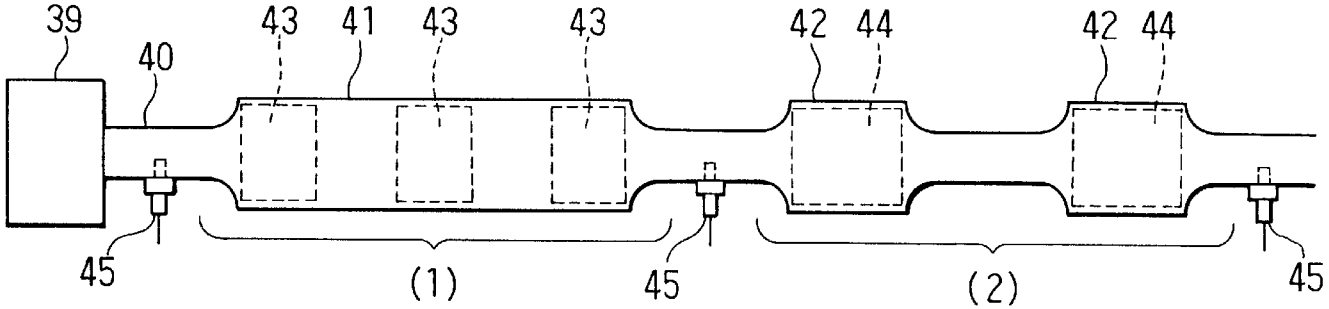
FIGS. 22A–22C are schematic structural diagrams of the exhaust systems of a sixth embodiment of the present invention with different methods of dividing catalysts into groups.

In a sixth embodiment, one large catalyst case 41 and two catalyst cases 42 are disposed in a row in an exhaust pipe 40 of engine 39. Three catalysts 43 are arranged with the predetermined spacing inside the upstream catalyst case 41, and one catalyst 44 is placed into each of the two downstream catalyst cases 42. In this case, as shown in FIG. 22A, the catalysts 44 are divided into a group of catalysts (1) including three catalysts 43 located inside the upstream catalyst case 41 and a group of catalysts (2) including two catalysts 44 located downstream thereof. Each group of catalysts is considered as a single catalyst, and sensors 45 such as air-fuel ratio sensors or oxygen sensors and the like are disposed upstream and downstream of each group of catalysts.

Figure 22B:
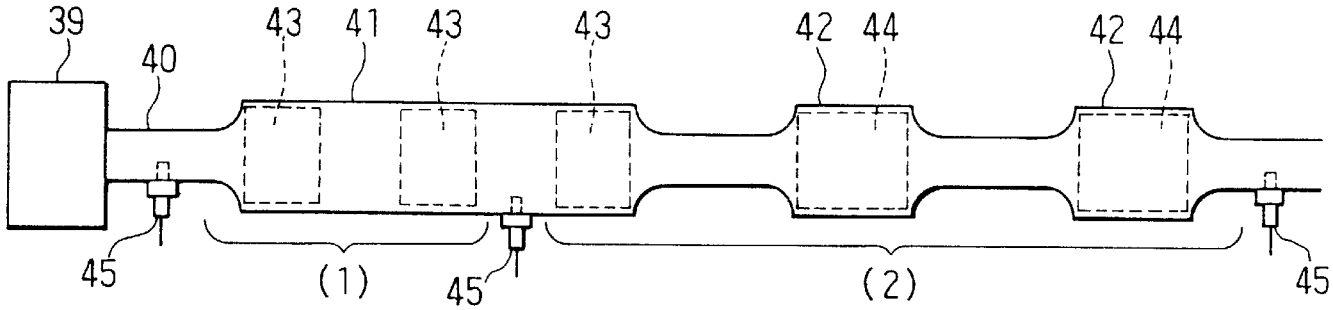

Furthermore, as shown in FIG. 22B, the catalysts 43 may be divided into a group of catalysts (1) including two catalysts 42 located upstream inside the upstream catalyst case 41 and a group of catalysts (2) including one catalyst 43 located downstream inside the upstream catalyst cases 41 and two catalysts 44 located downstream thereof. Sensors 45 may be disposed upstream and downstream of each group of catalysts.

Figure 22C:
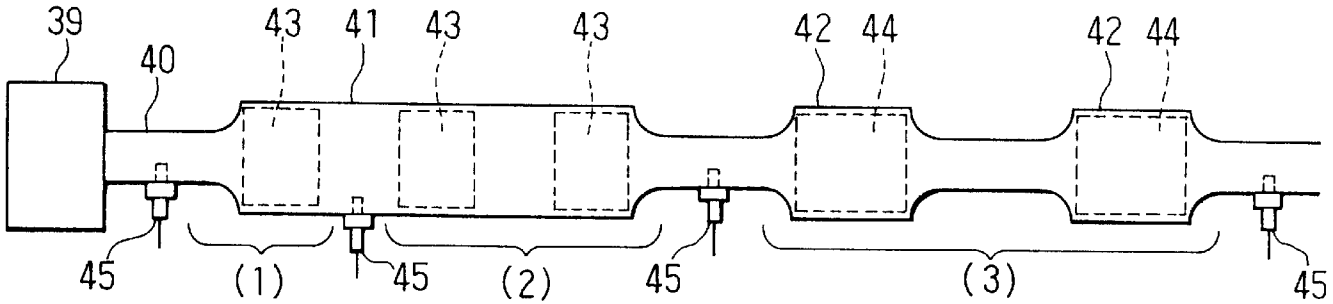

Further, as shown in FIG. 22C, the catalysts 44*b* may be divided into a group of catalysts (1) including one catalyst 43 located upstream inside the upstream catalyst case 41, a group of catalysts (2) including two catalysts 43 located downstream inside the upstream catalyst case 41, and a group of catalysts (3) including two catalysts 44 located downstream. Sensors 45 may be disposed upstream and downstream of each group of catalysts.

In the above fourth to sixth embodiments, the current exhaust gas purification capacity (storage amount and the like) can be evaluated for each catalyst (or each group of catalysts) based on the output of sensors disposed upstream and downstream of each catalyst (or each group of catalysts), an air-fuel ratio control can be conducted which has good response providing for full realization of the exhaust gas purification capacity of the whole catalytic system, and the exhaust gas purification capacity can be increased. Moreover, it also becomes possible to conduct catalyst deterioration evaluation for each catalyst (or each group of catalysts). Of course, the air-fuel ratio control of the first to third embodiments may be also conducted.

Furthermore, in the above embodiments, sensors that detects gas concentration such as HC concentration or NOx concentration and the like may be also used.

The present invention should not be limited to the disclosed embodiments, but may be implemented in many other ways without departing from the spirit of the invention.

What is claimed is:

1. An exhaust gas purification device for an internal combustion engine comprising:

a plurality of catalysts disposed in an exhaust gas passage of the internal combustion engine for exhaust gas purification;

sensors disposed upstream and downstream of the catalysts for detecting gas concentration of the exhaust gas; and a control unit for controlling operation of the internal combustion engine in response to outputs of the sensors, wherein the control unit includes:

air-fuel ratio feedback control means which feedback controls air-fuel ratio of the exhaust gas based on the output of the sensor located upstream of an upstream one of the catalysts; and feedback control correction means which estimates the amount of exhaust gas components adsorbed in the downstream catalyst based on the output of the sensor located upstream of the downstream catalyst, inlet air amount, the output of the sensor located upstream of the upstream catalyst, the amount of the exhaust gas components adsorbed in the upstream catalyst, and the relation between the specifications of upstream and downstream catalysts, and corrects the air-fuel ratio feedback control so as to eliminate shift from the control target value of the adsorbed amount.

2. The exhaust gas purification device as in claim 1, wherein the feedback control correction means sets the correction amount of air-fuel ratio feedback control within a range which does not exceed the total storage amount of a plurality of the catalysts.

3. An exhaust gas purification device for an internal combustion engine comprising:

at least three catalysts disposed in an exhaust gas passage of the internal combustion engine for exhaust gas purification, wherein the catalysts are divided into a plurality of groups of catalysts and each group of catalysts forms a single catalyst;

sensors disposed upstream and downstream of the each group of catalysts for detecting gas concentration of the exhaust gas; and a control unit for controlling operation of the internal combustion engine in response to outputs of the sensors, wherein the control unit includes:

air-fuel ratio feedback control means which feedback controls air-fuel ratio of the exhaust gas based on the output of the sensor located upstream of an upstream group of the catalysts; and feedback control correction means which estimates the amount of exhaust gas components adsorbed in the downstream group of catalysts based on the output of the sensor located upstream of a downstream group of the catalysts, inlet air amount, the output of the sensor located upstream of the upstream group of the catalysts, the amount of the exhaust gas components adsorbed in the upstream group of the catalysts, and the relation between the specifications of the upstream and downstream group of the catalysts, and corrects the air-fuel ratio feedback control so as to eliminate shift from the control target value of the adsorbed amount.

4. The exhaust gas purification device as in claim 3, wherein the feedback control correction means sets the correction amount of air-fuel ratio feedback control within a range which does not exceed the total storage amount of a plurality of the catalysts.

5. An exhaust gas purification device for an internal combustion engine comprising:

a plurality of catalysts disposed in an exhaust gas passage of the internal combustion engine for exhaust gas purification;

sensors disposed upstream and downstream of the catalysts for detecting gas concentration of the exhaust gas; and a control unit for controlling operation of the internal combustion engine in response to outputs of the sensors, wherein the control unit includes:

air-fuel ratio feedback controller which feedback controls air-fuel ratio of the exhaust gas based on the output of the sensor located upstream of an upstream one of the catalysts; and sub-feedback controller which causes the output of the downstream sensors to exert influence on the air-fuel ratio feedback control, the sub-feedback being capable of switching the sensors which exert influence on the air-fuel ratio feedback control, of a plurality of downstream sensors, according to operation state of the internal combustion engine.

6. The exhaust gas purification device as in claim 5, wherein:

the sub-feedback controller changes a method in which the output of the sensor exerts influence, according to a position of the sensor exerting influence on the air-fuel ratio feedback control.

7. The exhaust gas purification device as in claim 5, wherein the sub-feedback controller sets a target output of the sensor according to the position of the sensor exerting influence on the air-fuel ratio feedback control.

8. The exhaust gas purification device as in claim 5, wherein the control unit feedback controls, in response to one of the sensors disposed upstream of an upstream one of the catalysts, an air-fuel ratio of the exhaust gas to a target air-fuel ratio that is determined based on other sensors disposed downstream of the upstream one of the catalysts selected in accordance with exhaust gas flow.

9. An exhaust gas purification device for an internal combustion engine comprising:

a plurality of catalysts disposed in an exhaust gas passage of the internal combustion engine for exhaust gas purification;

sensors disposed upstream and downstream of the catalysts for detecting gas concentration of the exhaust gas; and a control unit for controlling operation of the internal combustion engine in response to outputs of the sensors, wherein the control unit includes:

first controller which feedback controls air-fuel ratio of the exhaust gas based on an output of a first one of the sensors located upstream of an upstream one of the catalysts;

second controller which exerts influence on an air-fuel ratio feedback control of the first controller based on an output of a second one of the sensors located downstream of the upstream one of the catalysts; and third controller which exerts influence on a control of the second controller based on an output of a third one of the sensors located downstream of a downstream one of the catalysts, so that the air-fuel ratio of the exhaust gas flowing in the downstream one of the catalysts is controlled to be within a predetermined purification window corresponding to the highest purification window of the downstream one of the catalysts;

wherein the third controller sets a target value of the second one of the sensors so that the target value of the second one of the sensors decreases as the output of the third one of the sensors increases in a predetermined air-fuel ratio range near a stoichiometric air-fuel ratio; and wherein the predetermined air-fuel ratio range is set to a range in which an amount of adsorption of the exhaust gas component in the downstream one of the catalysts becomes lower than a predetermined value, or the air-fuel ratio of the exhaust gas flowing in the downstream one of the catalysts falls within a predetermined exhaust purifying window.

10. An exhaust gas purification device for an internal combustion engine comprising:

a plurality of catalysts disposed in an exhaust gas passage of the internal combustion engine for exhaust gas purification;

sensors disposed upstream and downstream of the catalysts for detecting gas concentration of the exhaust gas; and a control unit for controlling operation of the internal combustion engine in response to outputs of the sensors, wherein the control unit includes:

first controller which feedback controls air-fuel ratio of the exhaust gas based on an output of a first one of the sensors located upstream of an upstream one of the catalysts;

second controller which exerts influence on an air-fuel ratio feedback control of the first controller based on an output of a second one of the sensors located downstream of the upstream one of the catalysts; and third controller which exerts influence on a control of the second controller based on an output of a third one of the sensors located downstream of a downstream one of the catalysts, so that the air-fuel ratio of the exhaust gas flowing in the downstream one of the catalysts is controlled to be within a predetermined purification window corresponding to the highest purification window of the downstream one of the catalysts;

wherein the third controller sets a target value of the second one of the sensors so that the target value of the second one of the sensors becomes a predetermined lower limit when the output of the third one of the sensors is larger than a predetermined value; and wherein the predetermined lower limit is set to a limit at which an amount of adsorption of the exhaust gas component in the downstream one of the catalysts becomes lower than a predetermined value, or the air-fuel ratio of the exhaust gas flowing in the downstream one of the catalysts falls within a predetermined exhaust purifying window.

11. An exhaust gas purification device for an internal combustion engine comprising:

a plurality of catalysts disposed in an exhaust gas passage of the internal combustion engine for exhaust gas purification;

sensors disposed upstream and downstream of the catalysts for detecting gas concentration of the exhaust gas; and a control unit for controlling operation of the internal combustion engine in response to outputs of the sensors, wherein the control unit includes:

first controller which feedback controls air-fuel ratio of the exhaust gas based on an output of a first one of the sensors located upstream of an upstream one of the catalysts;

second controller which exerts influence on an air-fuel ratio feedback control of the first controller based on an output of a second one of the sensors located downstream of the upstream one of the catalysts; and third controller which exerts influence on a control of the second controller based on an output of a third one of the sensors located downstream of a downstream one of the catalysts, so that the air-fuel ratio of the exhaust gas flowing in the downstream one of the catalysts is controlled to be within a predetermined purification window corresponding to the highest purification window of the downstream one of the catalysts;

wherein the third controller sets a target value of the second one of the sensors so that the target value of the second one of the sensors becomes a predetermined upper limit when the output of the third one of the sensors is smaller than a predetermined value; and wherein the predetermined upper limit is set to a limit at which an amount of adsorption of the exhaust gas component in the downstream one of the catalysts becomes lower than a predetermined value, or the air-fuel ratio of the exhaust gas flowing in the downstream one of the catalysts falls within a predetermined exhaust purifying window.

12. An exhaust gas purification device for an internal combustion engine comprising:

a plurality of catalysts disposed in an exhaust gas passage of the internal combustion engine for exhaust gas purification;

sensors disposed upstream and downstream of the catalysts for detecting gas concentration of the exhaust gas; and a control unit for controlling operation of the internal combustion engine in response to outputs of the sensors, wherein the control unit includes:

first controller which feedback controls air-fuel ratio of the exhaust gas based on an output of a first one of the sensors located upstream of an upstream one of the catalysts;

second controller which exerts influence on an air-fuel ratio feedback control of the first controller based on an output of a second one of the sensors located downstream of the upstream one of the catalysts; and third controller which exerts influence on a control of the second controller based on an output of a third one of the sensors located downstream of a downstream one of the catalysts, so that the air-fuel ratio of the exhaust gas flowing in the downstream one of the catalysts is controlled to be within a predetermined purification window corresponding to the highest purification window of the downstream one of the catalysts;

wherein the third controller sets a target value of the second one of the sensors so that the target value of the second one of the sensors becomes a predetermined lower limit and a predetermined upper limit when the output of the third one of the sensors is larger and smaller than a first and second predetermined value, respectively; and wherein the predetermined upper limit and the predetermined lower limit are set to a limit at which an amount of adsorption of the exhaust gas component in the downstream one of the catalysts becomes lower than a predetermined value, or the air-fuel ratio of the exhaust gas flowing in the downstream one of the catalysts falls within a predetermined exhaust purifying window.

13. An exhaust gas purification device for an internal combustion engine comprising:

at least three catalysts disposed in an exhaust gas passage of the internal combustion engine for exhaust gas purification, wherein the catalysts are divided into a plurality of groups of catalysts and each group of catalysts forms a single catalyst;

sensors disposed upstream and downstream of the each group of catalysts for detecting gas concentration of the exhaust gas; and a control unit for controlling operation of the internal combustion engine in response to outputs of the sensors, wherein the control unit includes:

air-fuel ratio feedback controller which feedback controls air-fuel ratio of the exhaust gas based on the output of the sensor located upstream of an upstream group of the catalysts; and sub-feedback controller which causes the output of the downstream sensors to exert influence on the air-fuel ratio feedback control, the sub-feedback controller being capable of switching the sensors which exert influence on the air-fuel ratio feedback control, of a plurality of downstream sensors, according to operation state of the internal combustion engine.

14. The exhaust gas purification device as in claim 13, wherein:

the sub-feedback controller changes a method in which the output of the sensor exerts influence according to a position of the sensor exerting influence on the air-fuel ratio feedback control.

15. The exhaust gas purification device as in claim 13, wherein the sub-feedback controller sets a target output of the sensor according to the position of the sensor exerting influence on the air-fuel ratio feedback control.

16. The exhaust gas purification device as in claim 13, wherein the control unit feedback controls, in response to one of the sensors disposed upstream of an upstream group of the catalysts, an air-fuel ratio of the exhaust gas to a target air-fuel ratio that is determined based on other sensors disposed downstream of the upstream group of the catalysts selected in accordance with exhaust gas flow.

17. An exhaust gas purification device for an internal combustion engine comprising:

at least three catalysts disposed in an exhaust gas passage of the internal combustion engine for exhaust gas purification, wherein the catalysts are divided into a plurality of groups of catalysts and each group of catalysts forms a single catalyst;

sensors disposed upstream and downstream of the each group of catalysts for detecting gas concentration of the exhaust gas; and a control unit for controlling operation of the internal combustion engine in response to outputs of the sensors, wherein the control unit includes:

first controller which feedback controls air-fuel ratio of the exhaust gas based on an output of a first one of the sensors located upstream of an upstream group of the catalysts;

second controller which exerts influence on an air-fuel ratio feedback control of the first controller based on an output of a second one of the sensors located downstream of the upstream group of the catalysts; and third controller which exerts influence on a control of the second controller based on an output of a third one of the sensors located downstream of a downstream group of the catalysts, so that the air-fuel ratio of the exhaust gas flowing in the downstream group of the catalysts is controlled to be within a predetermined purification window corresponding to the highest purification window of the downstream group of catalysts;

wherein the third controller sets a target value of the second one of the sensors so that the target value of the second one of the sensors decreases as the output of the third one of the sensors increases in a predetermined air-fuel ratio range near a stoichiometric air-fuel ratio; and wherein the predetermined air-fuel ratio range is set to a range in which an amount of adsorption of the exhaust gas component in the downstream one of the catalysts becomes lower than a predetermined value, or the air-fuel ratio of the exhaust gas flowing in the downstream one of the catalysts falls within a predetermined exhaust purifying window.

18. An exhaust gas purification device for an internal combustion engine comprising:

at least three catalysts disposed in an exhaust gas passage of the internal combustion engine for exhaust gas purification, wherein the catalysts are divided into a plurality of groups of catalysts and each group of catalysts forms a single catalyst;

sensors disposed upstream and downstream of the each group of catalysts for detecting gas concentration of the exhaust gas; and a control unit for controlling operation of the internal combustion engine in response to outputs of the sensors, wherein the control unit includes:

first controller which feedback controls air-fuel ratio of the exhaust gas based on an output of a first one of the sensors located upstream of an upstream group of the catalysts;

second controller which exerts influence on an air-fuel ratio feedback control of the first controller based on an output of a second one of the sensors located downstream of the upstream group of the catalysts; and third controller which exerts influence on a control of the second controller based on an output of a third one of the sensors located downstream of a downstream group of the catalysts, so that the air-fuel ratio of the exhaust gas flowing in the downstream group of the catalysts is controlled to be within a predetermined purification window corresponding to the highest purification window of the downstream group of catalysts;

wherein the third controller sets a target value of the second one of the sensors so that the target value of the second one of the sensors becomes a predetermined lower limit when the output of the third one of the sensors is larger than a predetermined value; and wherein the predetermined lower limit is set to a limit at which an amount of adsorption of the exhaust gas component in the downstream one of the catalysts becomes lower than a predetermined value, or the air-fuel ratio of the exhaust gas flowing in the downstream one of the catalysts falls within a predetermined exhaust purifying window.

19. An exhaust gas purification device for an internal combustion engine comprising:

at least three catalysts disposed in an exhaust gas passage of the internal combustion engine for exhaust gas purification, wherein the catalysts are divided into a plurality of groups of catalysts and each group of catalysts forms a single catalyst;

sensors disposed upstream and downstream of the each group of catalysts for detecting gas concentration of the exhaust gas; and a control unit for controlling operation of the internal combustion engine in response to outputs of the sensors, wherein the control unit includes:

first controller which feedback controls air-fuel ratio of the exhaust gas based on an output of a first one of the sensors located upstream of an upstream group of the catalysts;

second controller which exerts influence on an air-fuel ratio feedback control of the first controller based on an output of a second one of the sensors located downstream of the upstream group of the catalysts; and third controller which exerts influence on a control of the second controller based on an output of a third one of the sensors located downstream of a downstream group of the catalysts, so that the air-fuel ratio of the exhaust gas flowing in the downstream group of the catalysts is controlled to be within a predetermined purification window corresponding to the highest purification window of the downstream group of catalysts;

wherein the third controller sets a target value of the second one of the sensors so that the target value of the second one of the sensors becomes a predetermined upper limit when the output of the third one of the sensors is smaller than a predetermined value; and wherein the predetermined upper limit is set to a limit at which an amount of adsorption of the exhaust gas component in the downstream one of the catalysts becomes lower than a predetermined value, or the air-fuel ratio of the exhaust gas flowing in the downstream one of the catalysts falls within a predetermined exhaust purifying window.

20. An exhaust gas purification device for an internal combustion engine comprising:

at least three catalysts disposed in an exhaust gas passage of the internal combustion engine for exhaust gas purification, wherein the catalysts are divided into a plurality of groups of catalysts and each group of catalysts forms a single catalyst;

sensors disposed upstream and downstream of the each group of catalysts for detecting gas concentration of the exhaust gas; and a control unit for controlling operation of the internal combustion engine in response to outputs of the sensors, wherein the control unit includes:

first controller which feedback controls air-fuel ratio of the exhaust gas based on an output of a first one of the sensors located upstream of an upstream group of the catalysts;

second controller which exerts influence on an air-fuel ratio feedback control of the first controller based on an output of a second one of the sensors located downstream of the upstream group of the catalysts; and third controller which exerts influence on a control of the second controller based on an output of a third one of the sensors located downstream of a downstream group of the catalysts, so that the air-fuel ratio of the exhaust gas flowing in the downstream group of the catalysts is controlled to be within a predetermined purification window corresponding to the highest purification window of the downstream group of catalysts;

wherein the third controller sets a target value of the second one of the sensors so that the target value of the second one of the sensors becomes a predetermined lower limit and a predetermined upper limit when the output of the third one of the sensors is larger and smaller than a first and second predetermined value, respectively; and wherein the predetermined upper limit and the predetermined lower limit are set to a limit at which an amount of adsorption of the exhaust gas component in the downstream one of the catalysts becomes lower than a predetermined value, or the air-fuel ratio of the exhaust gas flowing in the downstream one of the catalysts falls within a predetermined exhaust purifying window.

* * * * *